US010076174B2

(12) United States Patent
Tobey

(10) Patent No.: US 10,076,174 B2
(45) Date of Patent: Sep. 18, 2018

(54) SUBSTANTIVELY HERMETICALLY SEALING CONTAINER

(71) Applicant: Ted Tobey, Honolulu, HI (US)

(72) Inventor: Ted Tobey, Honolulu, HI (US)

( * ) Notice: Subject to any disclaimer, the term of this patent is extended or adjusted under 35 U.S.C. 154(b) by 0 days.

(21) Appl. No.: 15/676,878

(22) Filed: Aug. 14, 2017

(65) Prior Publication Data

US 2018/0016055 A1 Jan. 18, 2018

Related U.S. Application Data

(63) Continuation-in-part of application No. 14/064,141, filed on Oct. 27, 2013, now Pat. No. 9,764,881.

(60) Provisional application No. 62/431,438, filed on Dec. 8, 2016.

(51) Int. Cl.

| | |
|---|---|
| ***A45D 33/34*** | (2006.01) |
| ***A45D 33/00*** | (2006.01) |
| ***B65D 13/02*** | (2006.01) |
| ***B65D 8/00*** | (2006.01) |
| ***B65D 47/04*** | (2006.01) |
| ***B65D 51/18*** | (2006.01) |
| ***B65D 51/24*** | (2006.01) |

(52) U.S. Cl.

CPC ..... *A45D 33/006* (2013.01); *B65D 9/02* (2013.01); *B65D 11/02* (2013.01); *B65D 13/02* (2013.01); *B65D 47/043* (2013.01); *B65D 51/18* (2013.01); *B65D 51/24* (2013.01); *B65D 7/04* (2013.01); *B65D 2251/0018* (2013.01); *B65D 2251/0037* (2013.01); *B65D 2251/0043* (2013.01); *B65D 2251/0068* (2013.01); *B65D 2251/0075* (2013.01); *B65D 2251/0087* (2013.01)

(58) Field of Classification Search

CPC ..... B65D 7/04; B65D 51/18; B65D 47/043; B65D 11/02; B65D 13/02; B65D 9/02; B65D 2251/0037; B65D 2251/0068

USPC ..... 132/307

See application file for complete search history.

(56) References Cited

U.S. PATENT DOCUMENTS

| | | | | |
|---|---|---|---|---|
| 1,630,437 | A * | 5/1927 | Kjellstrom | A45D 33/02 132/307 |
| 3,973,690 | A | 8/1976 | Schneider | |
| 8,132,578 | B2 | 3/2012 | LoPrete | |
| 8,630,259 | B2 | 1/2014 | Tenny et al. | |
| 2005/0109363 | A1* | 5/2005 | Matsuoka | A45D 33/02 132/298 |
| 2009/0205673 | A1 | 8/2009 | Richardson | |
| 2012/0090637 | A1* | 4/2012 | Holloway | A45D 33/02 132/299 |
| 2016/0015148 | A1* | 1/2016 | Chang | A45D 33/16 220/212.5 |

* cited by examiner

*Primary Examiner* — James N Smalley
(74) *Attorney, Agent, or Firm* — Patrick Reilly

(57) ABSTRACT

A container that seals in a volume of material is provided. The container may be routinely opened, closed and material may be removed or added. A removable plate and a base define a maximum volume available for material when the container is sealed. A screen may be disposed between the plate and the base. The screen may optionally be comprised within the base, adhered to the base, or removable from the base. Features for enabling manipulation of the plate and/or screen are optionally provided.

20 Claims, 33 Drawing Sheets

SUBSTANTIVELY HERMETICALLY SEALING CONTAINER

CO-PENDING PATENT APPLICATIONS

This Nonprovisional Patent Application is a Continuation-in-Part application to Nonprovisional patent application Ser. No. 14/064,141 as filed on Oct. 27, 2013 by Inventor Ted Tobey and titled SUBSTANTIVELY HERMETICALLY SEALING CONTAINER. Said Nonprovisional patent application Ser. No. 14/064,141 is hereby incorporated in its entirety and for all purposes into the present Nonprovisional Continuation-in-Part Patent Application.

In addition, this Nonprovisional Patent Application is also a Continuation-in-Part application to Provisional Patent Application Ser. No. 62/431,438 as filed on Dec. 8, 2016 by Inventor Ted Tobey and titled SUBSTANTIVELY HERMETICALLY SEALING CONTAINER. Said Provisional Patent Application Ser. No. 62/431,438 is hereby incorporated in its entirety and for all purposes into the present Nonprovisional Continuation-in-Part Patent Application.

TECHNICAL FIELD

The present invention relates to containers for cosmetic, hygiene, and other consumer products in powdered or liquid form, and particularly hermetically sealing containers. The present invention also relates to containers for condiments, food, and drinks.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Cosmetic applicators for skin care products, particularly deodorants and antiperspirants, have seen little innovation in the last several decades. The proposed invention directly addresses a consumer desire for an applicator system that conforms to irregular body surfaces for application of creams, lotions and liquids that avoids the messiness of using one's fingers while insuring a smooth, quick, uniform application of the cosmetic. This invention achieves that by utilizing a fully captured absorbent cosmetic pad held in place over a hemispherical applicator tool by a porous cover also able to conform to this unusual shape while simultaneously creating an attractive finished design. The proposed applicator system will also allow for the use of simplified water-based or oil-based cosmetic preparations that use fewer complex chemical ingredients ultimately improving customer satisfaction.

Many commercial airline passengers need or desire to carry cosmetic products or medications on board and use these formulations during their travels. However, the security processes at airports have become much more stringent, particularly since the terrorist attack in New York on Sep. 11, 2001. Passengers are often only permitted to carry a limited number of small containers in which liquid material is stored. Also, security officers are typically required to direct passengers to open these containers to inspect the enclosed material and any other content.

Conventional containers provide some solutions to control the release of the content material. U.S. Pat. No. 8,132,578 discloses a removable sifter disk inserted in a cosmetic package to control the release of the powdered content material. U.S. Pat. No. 8,360,259 discloses automatic opening-and-closing discharging structure in a jar. However, the prior art fails to optimally provide easily inspectable devices of preconfigured internal volume. There is a therefore a long-felt need to develop sealing containers that contain specific volumes of material and can easily be opened and resealed during security inspections.

SUMMARY AND OBJECTS OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments provide improved sealing containers. It is an object of the present invention to provide sealing containers that may be opened and resealed and define a predetermined maximum volume of material when in a sealed state.

In one embodiment, such containers include a base with an internal ledge extending from the internal surface of the base wall towards the central axis of the base, a cover with a pressure ledge on its internal surface, and a sealing plate residing upon the perimeter lip of a screen adapted to reside on the base wall internal ledge and sealing the content material when the cover and the base are coupled. A sealing of the content material is removably formed between by forcing the cover pressure ledge against the substantively impermeable sealing plate and toward a bottom of the base whereby the sealing plate is compressed against the screen perimeter lip. The sealing plate and the internal cavity of the base define a maximum volume of material that may be contained when the invented container is on a closed state.

In another alternate preferred embodiment, a second screen is detachable from the base. Optional features may be included in the second screen design to allow ease of manual handling of the screen such as insertion and removal of the screen relative to the base.

BRIEF DESCRIPTION OF THE DRAWINGS

These, and further features of the invention, may be better understood with reference to the accompanying specification and drawings depicting the preferred embodiment, in which.

DETAILED DESCRIPTION

It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims.

Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1A:
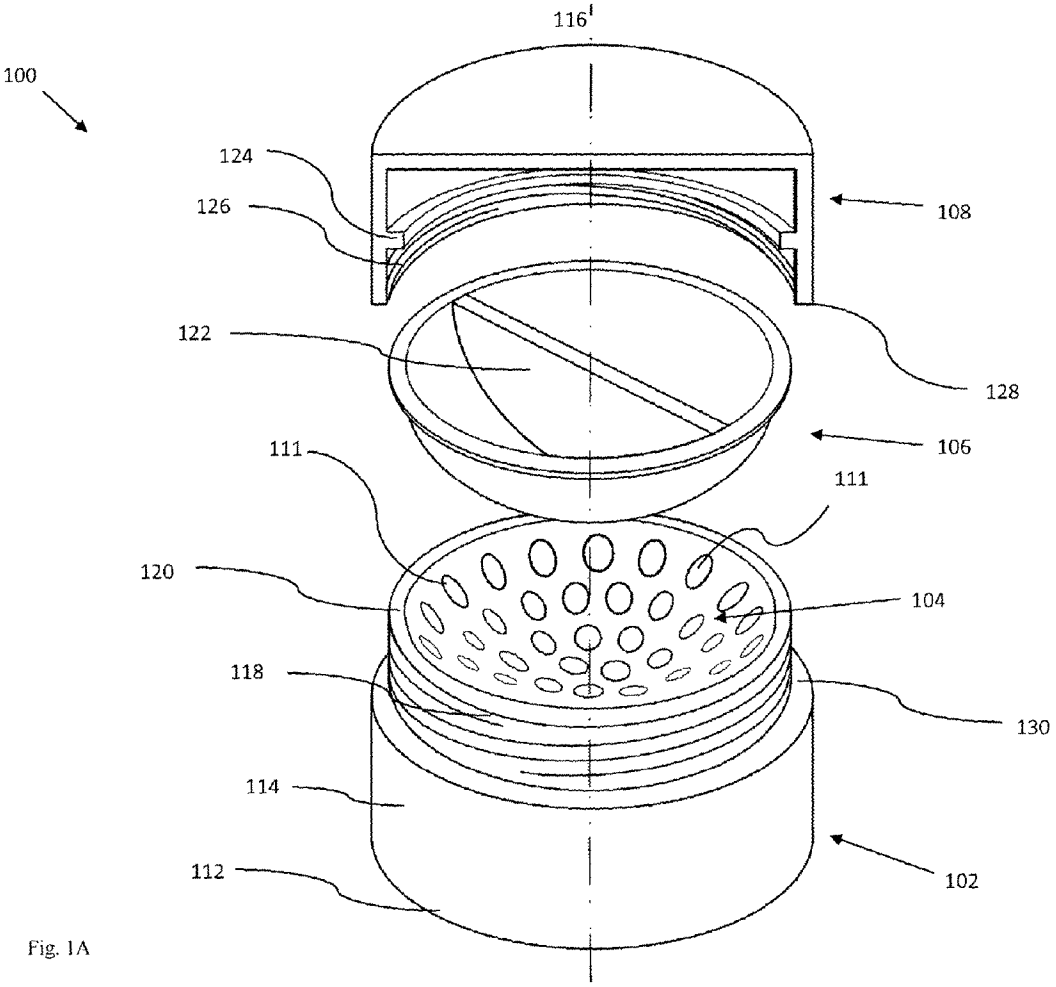
FIG. 1A is a perspective view of a hermetically sealing container according to a first embodiment of the invented container, wherein a base comprises a screen.
Figure 1B:
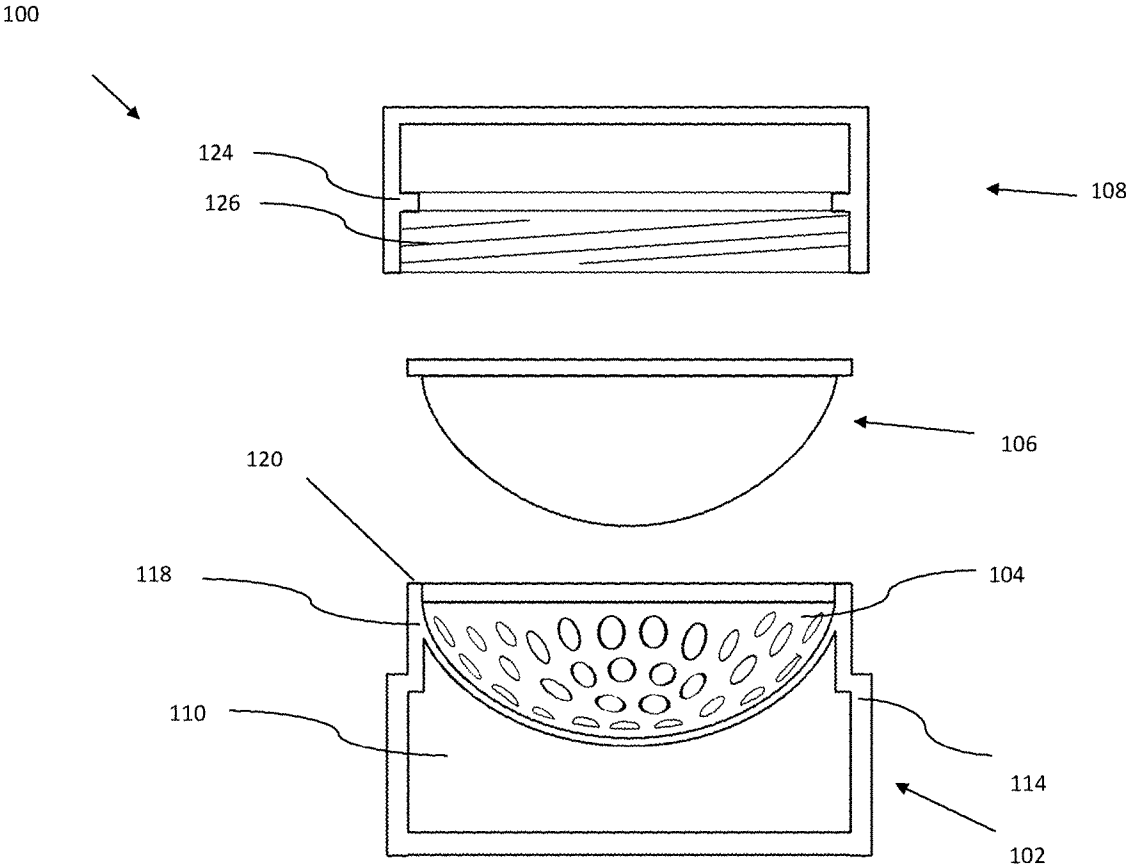
FIG. 1B is a cutaway side-view of the first embodiment of FIG. 1A.

Referring generally to the Figures and particularly to FIG. 1A and FIG. 1B, FIG. 1A and FIG. 1B illustrate a substantively hermetically sealing first container 100 according to a first embodiment. As shown in FIG. 1A and FIG. 1B, the first container 100 includes three detachable components, namely a first base 102 having a first screen 104, a first sealing plate 106, and a first cover 108. The first container 100 may be or comprise metal, plastic, wood or wood composite, ceramic or other suitable material known in the art in combination or in singularity.

As shown in FIG. 1B, extending from an internal surface of the first base 102, the first base 102 defines a first reservoir 110, wherein a content material (not shown) of the first container 100 is stored. Fluids and sufficiently small particulates may enter and exit the first reservoir 110 through one or more first screen apertures 111 formed within and extending through the first screen 104.

In the first embodiment, the first base 102 has a first bottom 112 at a first end, and a first wall 114 extends from the first bottom 112. In the first container 100, the first wall 114 extends from the first bottom 112 at least partly along a first central axis 116. In the first container 100, near a second end of the first base 102 that is opposite to its first end, the first outer surface of the first wall 114 includes an attachment first section 118. The attachment section first 118 is threaded. In first embodiment, attachment first section 118 includes a first screen 104.

As shown in FIG. 1A and FIG. 1B, the first screen 104 is preferably porous, permitting the content material housed within the first reservoir 110 to pass through the first screen 104. As further shown in FIG. 1A and FIG. 1B, the first sealing plate 106 is adapted to sit upon the first screen 104 and be pressed against a first perimeter lip 120 of the first base 102 by compressive force delivered from the first cover 108 and to substantively inhibit exit of the content material from the first reservoir 110. The first sealing plate 106 thereby forms a substantive hermetic seal with the first base 102 that substantively or completely inhibits exit of the content material from within the first container 100. The first sealing plate 106 is adapted to rest upon the first perimeter lip 120 while receiving compressive force from the first cover 108. As shown in FIG. 1A, the first sealing plate 106 also includes a first handle 122 that may be manipulated by a user to separate the first sealing plate 106 from the first screen 104 or the first base 102.

As still further shown in FIG. 1A and FIG. 1B, the first cover 108 is adapted to direct compressive force against the first sealing plate 106 and toward the first base 102 via a first cover pressuring feature 124, and to thereby substantively seal the content material within in the reservoir 110. The cover pressuring feature 124 is a portion of the first cover 108. The first cover 108 further includes a first cover attachment feature 126 that is adapted to detachably couple with the first base attachment section 118. In first embodiment, as shown in FIGS. 1A and 1B, the first cover attachment feature 126 is tapped and is adapted to engage with the threaded attachment first section 118 of the base 102 and thereby provide compressive force from the cover pressuring feature 124 to the first screen 104 and toward the first perimeter lip 120 of the first base 102. The first cover 108 is shaped in combination with the first base 102 to fully enclose the first sealing plate 106 when the first cover 108 and the first base 102 are coupled.

It is understood that the first cover 108 is sized and shaped such that, in a first preferred embodiment of the method of the invention, a lower lip 128 of the first cover 108 is not positioned sufficiently proximate to a first side ledge 130 of the first wall of the first base 102 to enable transfer of force from the first cover 108 and to the first side ledge 130 when force is being transferred from the first cover pressuring feature 124 of the first cover 108 to the first sealing plate 106. The first container 100 is thus shaped such that compressive force may be transferred from the first cover 108 to the first sealing plate 106 without substantive limitation by interference with the first side ledge 130 of the first base 102.

Figure 2A:
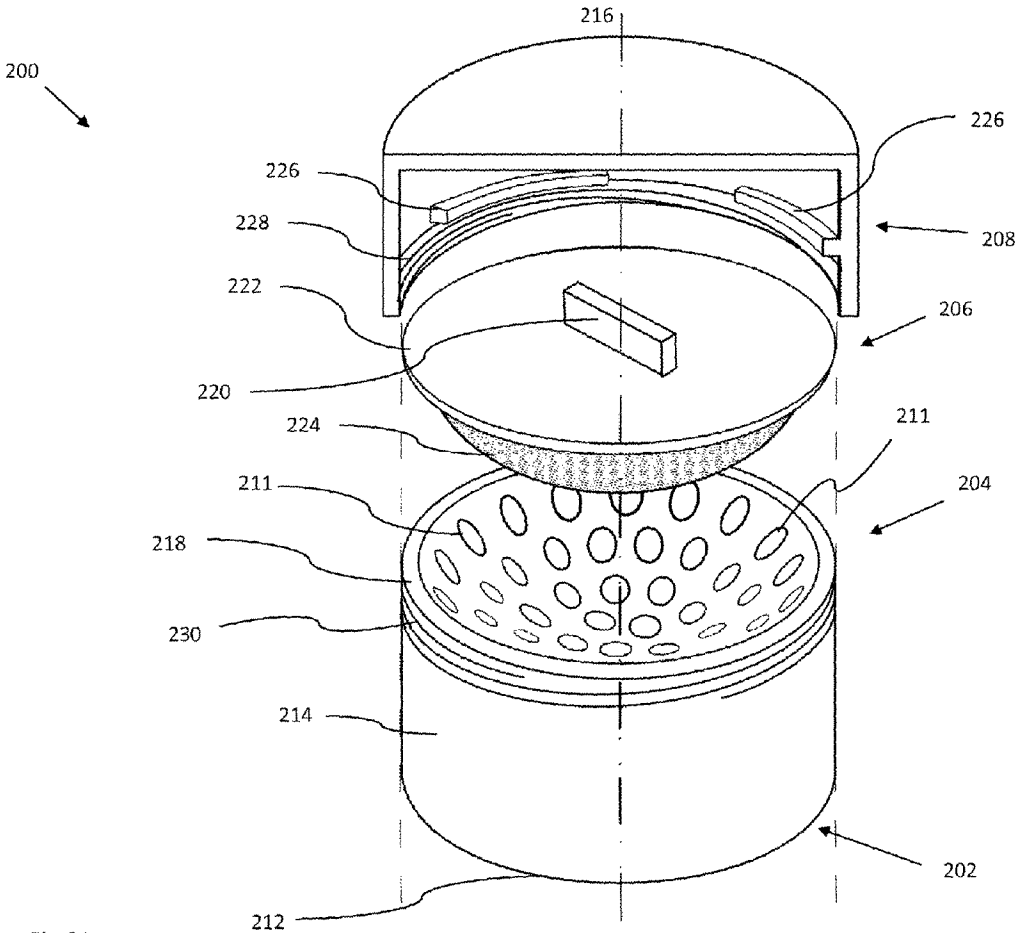
FIG. 2A is a perspective view of a hermetically sealing container according to a second embodiment of the invented container, wherein a base comprises a screen and the cover has two or more relieved pressure features.
Figure 2B:
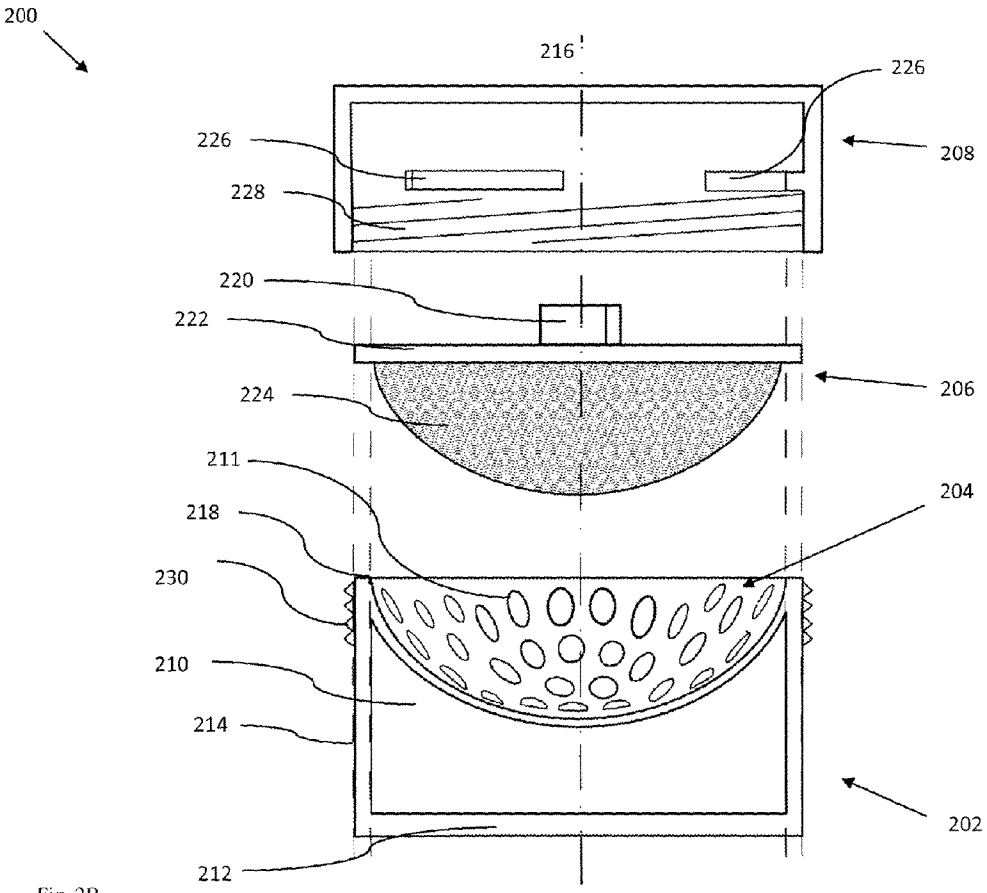
FIG. 2B is a cutaway side-view of the second embodiment of FIG. 2A.
Figure 2C:
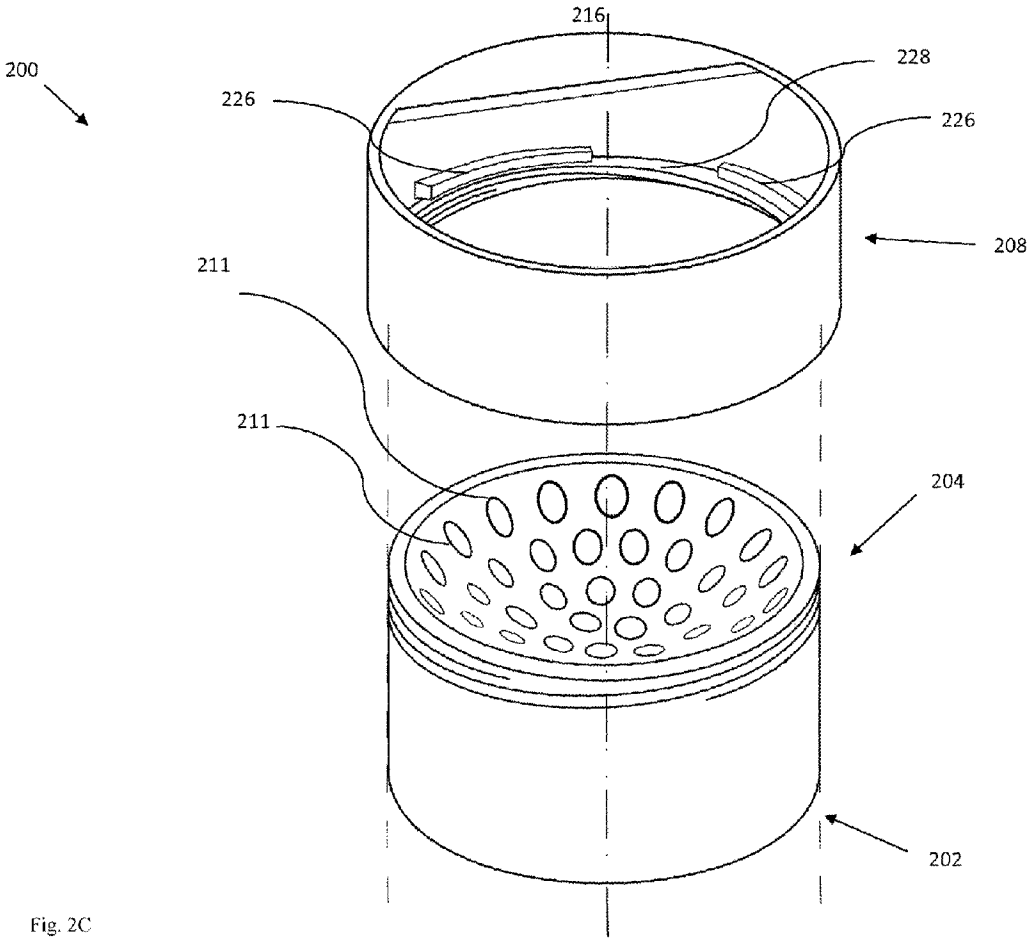
FIG. 2C is a cutaway top perspective view of the second embodiment of FIG. 2B.

Referring now generally to the Figures and particularly to FIGS. 2A, 2B and 2C, FIGS. 2A, 2B and 2C illustrate a substantively hermetically sealing second container 200 structured according to a second embodiment. As shown in FIGS. 2A, 2B and 2C, the second container 200 includes a second base 202 having a second screen 204, a second sealing plate 206, and a second cover 208. The second container 200 may be or comprise metal, plastic, wood or wood composite, ceramic or other suitable material known in the art in combination or in singularity.

As shown in FIG. 2B, extending from the internal surface of the second base 202, the second base 202 defines a second reservoir 210, wherein the content material is stored. In the second container 200, the second base 202 has a second bottom 212 at a first end, and a second wall 214 extends from the second bottom 212. A second wall 214 of the second base 202 extends from the second bottom 212 at least partly along a second central axis 216. Near a second end of the second base 202 that is opposite to its first end, the outer surface of the second wall 214 is threaded. The second wall 214 is connected with a second screen 204 of the second base 202. Fluids and sufficiently small particulates may enter and exit the second reservoir 210 through one or more second screen apertures 211 formed within and extending through the second screen 204.

As shown in FIGS. 2A, 2B and 2C, the second screen 204 is porous, permitting the content material stored within the second reservoir 210 to pass through the second screen and out of the second base 202.

As shown in FIGS. 2A, 2B and 2C, the second sealing plate 206 is adapted to sit upon the second screen 204 and to substantively inhibit exit of the content material from the second reservoir 210. The second sealing plate 206 forms a substantively hermetic sealing that substantively completely inhibits exit of the content material from within the second container 200. The second sealing plate 206 is adapted to rest upon the second perimeter lip 218. As shown in FIGS. 2A, 2B and 2C, the second sealing plate 206 also includes a second handle 220 that may be manipulated by a user to separate the second sealing plate 206 from the second screen 204, i.e., from the second base 202. The second sealing plate 206 includes a second holding plate 222 and a second applicator pad 224, The second applicator pad 224 is adapted to absorb and/or adhere content material from within the second base 202.

As shown in FIGS. 2A, 2B and 2C, the second cover 208 is adapted to direct compressive force (a.) against the second sealing plate 206 and (b.) toward the second base 202 via a second cover pressuring features 226, and thereby to substantively seal the content material within in the second reservoir 210. The cover pressuring features 226 are each portions of the second cover 208. The second cover 208 includes a second cover attachment feature 228 that is adapted to detachably couple with the second base 202. The second cover attachment feature 228 is tapped and a base attachment feature 230 is threaded, wherein the second cover attachment feature 228 and the second base attachment feature 230 are adapted to engage to form a coupling of the second base 202 and the second cover 206. The second cover 208 may thus be manually screwed down by a user about the second base attachment feature 230 and toward the second bottom 212 of the second base 202 whereby drive compressive force is directed by the second cover 208 and against the second sealing plate 206 and toward the second perimeter lip 218 of the second base 202.

The second cover 208 is shaped in combination with the second base 202 to fully enclose the second sealing plate 206 when the second cover 208 and the second base 202 are coupled.

Figure 3A:
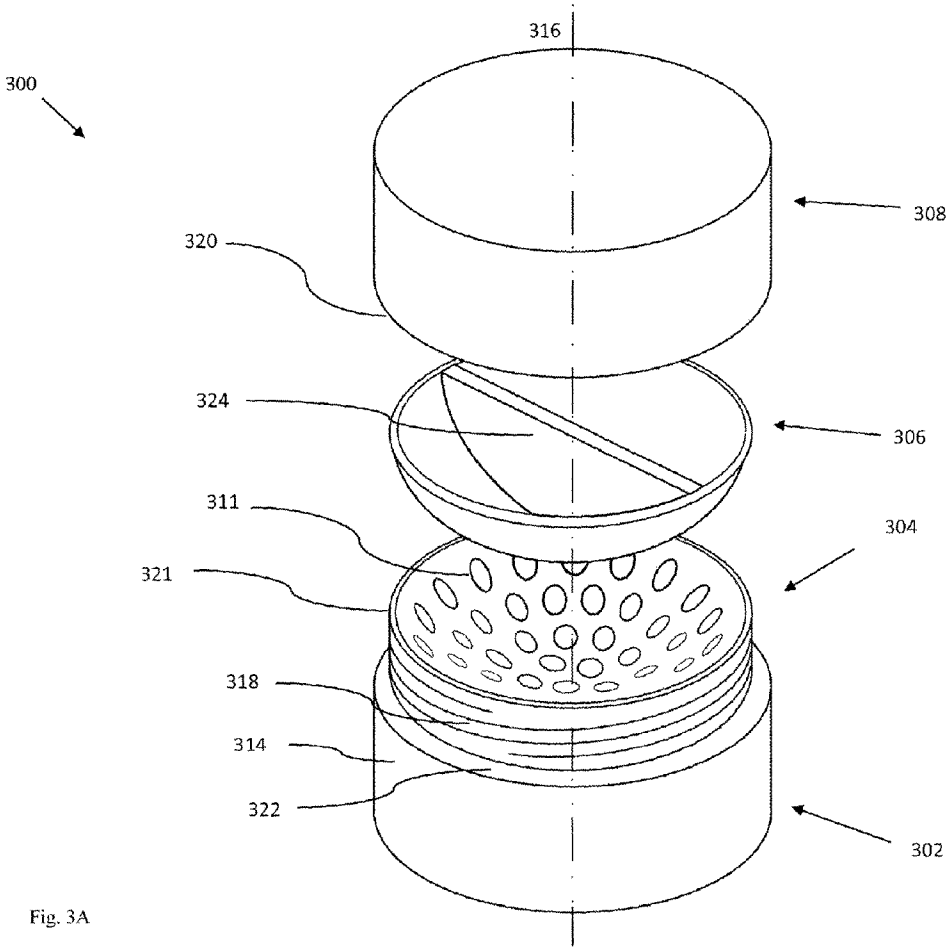
FIG. 3A is a perspective view of a hermetically sealing container according to a third embodiment of the invented container, wherein a third sealing plate is presented.
Figure 3B:
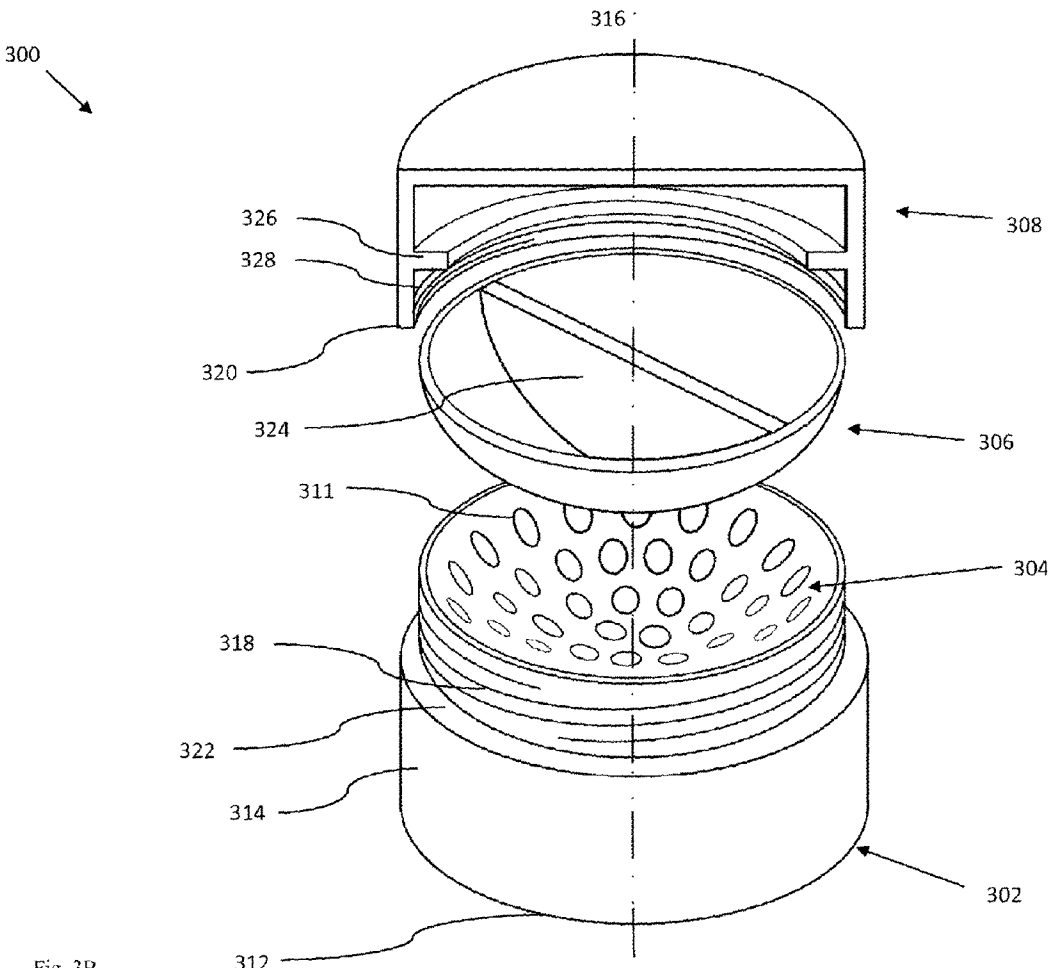
FIG. 3B is a partially cutaway perspective view of the third embodiment of FIG. 3A.
Figure 3C:
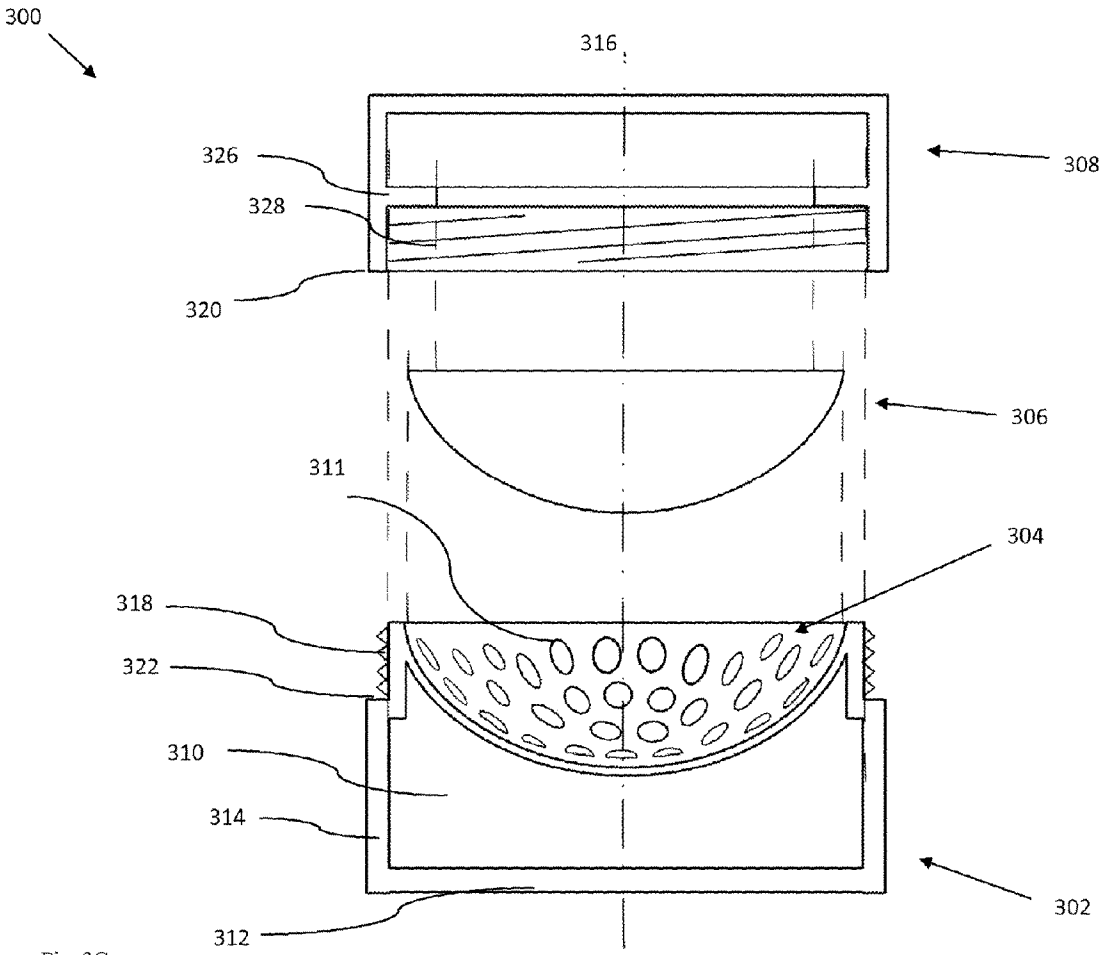
FIG. 3C is a cutaway side-view of the third embodiment of FIG. 3A.

Referring generally to the Figures and particularly to FIG. 3A, FIG. 3B and FIG. 3C, FIGS. 3A, 3B and 3C illustrate a substantively hermetically sealing third container 300 according to third embodiment of the present invention. As shown in FIGS. 3A, 3B and 3C, the third container 300 includes a third base 302 with a third screen 304, a third sealing plate 306, and a third cover 308. The third container 300 may be or comprise metal, plastic, wood or wood composite, ceramic or other suitable material known in the art in combination or in singularity.

As shown in FIGS. 3A, 3B and 3C, extending from an internal surface of the third base 302 defines a third reservoir 310, wherein the content material of the third container 300 is stored. Fluids and sufficiently small particulates may pass through the third screen 304, and thereby enter and exit the third reservoir 310, through one or more third screen apertures 311 formed within and extending through the third screen 304.

The third base 302 has a third bottom 312 at a first end, and a third wall 314 extending from the third bottom 312. The third wall 314 extends from the third bottom 312 at least partly along a third central axis 316. Near a second end of the third base 302 that is opposite to its first end of the third base 302, an outer surface of the third wall 314 includes a third attachment section 318. The third attachment section 318 is threaded.

As shown in FIGS. 3A, 3B and 3C, the third screen 304 is porous and permitting the content material in the third reservoir 310 to pass through the third screen 304 and from within the third base 302.

As shown in FIGS. 3A, 3B and 3C, the third sealing plate 306 is adapted to be pressed against the third screen 304 by compressive force delivered from the third cover 308 and to substantively inhibit exit of the content material from within the third reservoir 310. The third sealing plate 306 is adapted to form a hermetic sealing that substantively or completely inhibits exit of the content material from within the third container 300.

It is understood that the third cover 308 is sized and shaped such that, in a third preferred embodiment of the method of the invention, a third lower lip 320 of the third wall of the third cover 308 is not positioned sufficiently proximate to a third side ledge 322 of the third base 302 to enable transfer of force from the third cover 308 and to the third side ledge 322 when force is being transferred from the third cover 308 to the third sealing plate 306. The third container 300 is thus shaped such that compressive force may be transferred from the third cover 308 to the third sealing plate 306 without substantive limitation due to interference between the third side ledge 322 of the third base 302 and the third cover 308.

The third sealing plate 306 is adapted to rest upon the third screen 304. In third embodiment, as shown in FIGS. 3A, 3B and 3C, the third sealing plate 306 also includes a third handle 324 with which a user may manipulate to separate the third sealing plate 306 from the third screen 304 and the third base 302.

As shown in FIGS. 3A, 3B and 3C, the third cover 308 is adapted to direct compressive force against the third sealing plate 306 and toward the third base 302 from a cover pressuring feature 326, and to thereby substantively seal the content material within the third reservoir 310. The third cover pressuring feature 326 is a portion of the third cover 308. The third cover 308 further includes a third cover tapped attachment feature 328 that is adapted to detachably couple with the threaded third attachment section 318 of the third base 302. In the third container 300, as shown in FIGS. 3A, 3B and 3C, the third cover attachment feature 328 is tapped. The third cover 308 is shaped in combination with the third base 302 to fully enclose and press against the third sealing plate 306 when the third cover 308 and the third base 302 are fully or substantively coupled by engagement and coupling of the third cover tapped attachment feature 328 of the third cover 308 with the threaded third attachment section 318 of the third base 302.

Figure 4A:
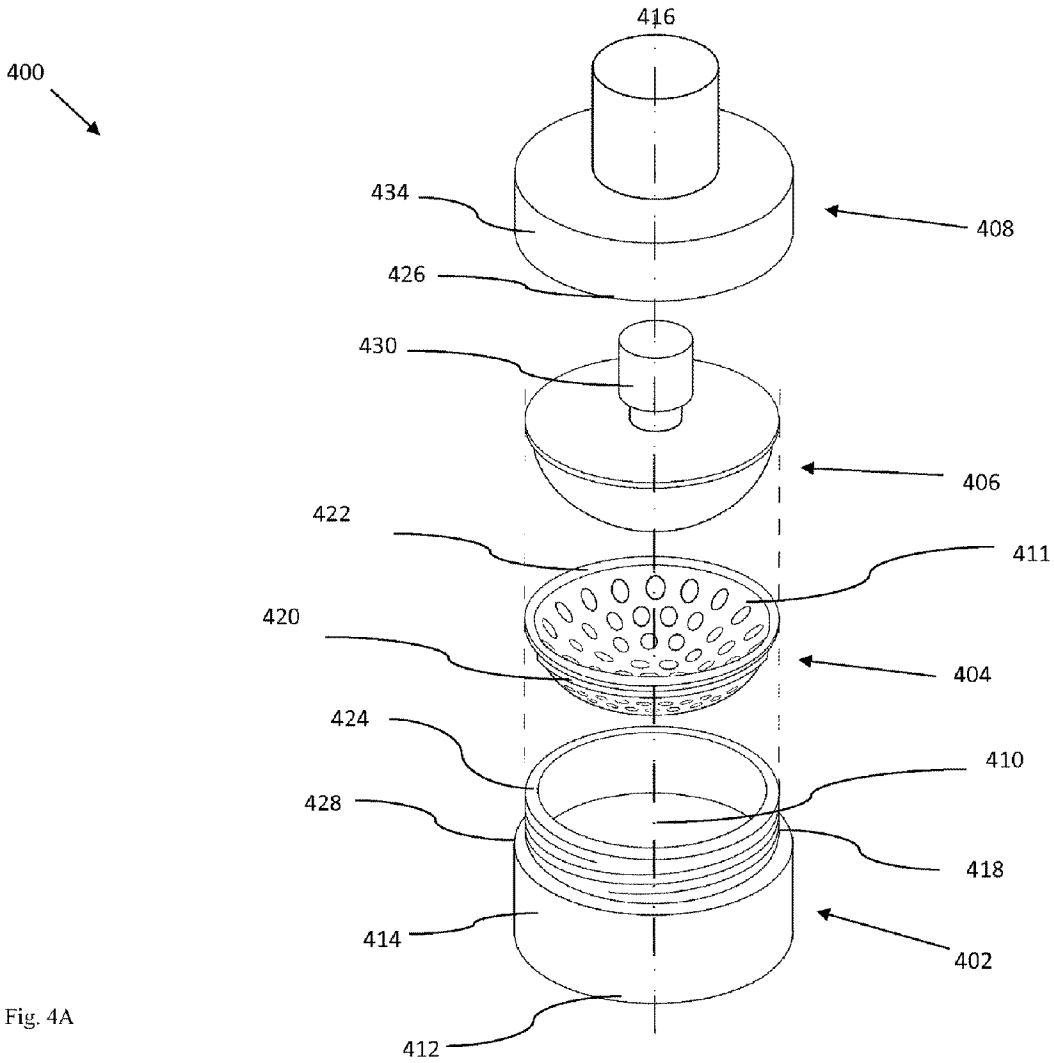
FIG. 4A is a perspective view of a hermetically sealing container according to a fourth embodiment of the invented container, wherein a fourth screen is removable from a fourth base.
Figure 4B:
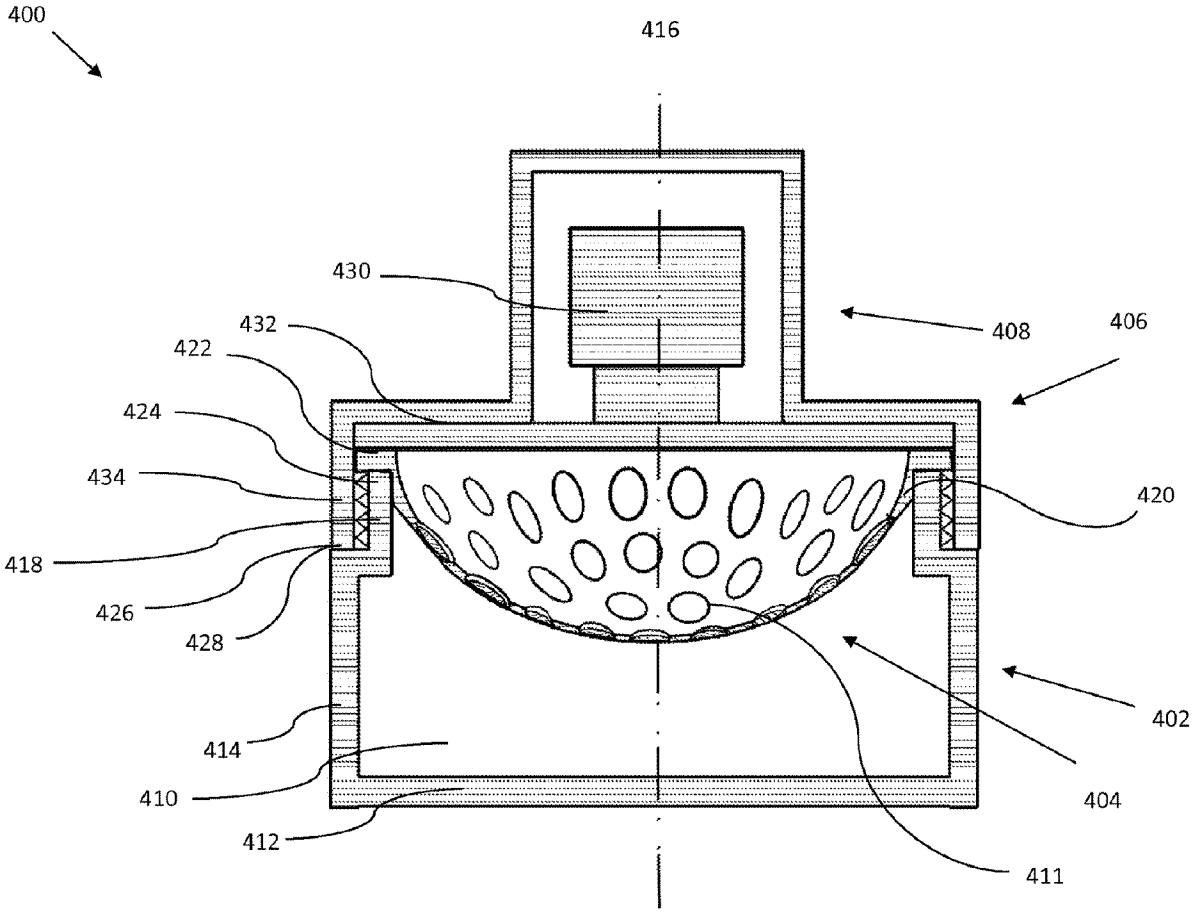
FIG. 4B is a cutaway side-view of the fourth embodiment of FIG. 4A.

Referring now generally to the Figures and particularly to FIGS. 4A and 4B, FIG. 4A and FIG. 4B illustrate a substantively hermetically sealing container according to fourth embodiment. As shown in FIG. 4A and FIG. 4B, a fourth container 400 includes a fourth base 402, a fourth screen 404, a fourth sealing plate 406, and a fourth cover 408. The fourth container 400 may be or comprise metal, plastic, wood or wood composite, ceramic or other suitable material known in the art in combination or in singularity.

As shown in FIG. 4B, extending from the internal surface of the fourth base 402, the fourth base 402 defines a fourth reservoir 410, wherein the content material of the fourth container 400 is stored. Fluids and sufficiently small particulates may pass through the fourth screen 404, and thereby enter and exit the fourth reservoir 410, through one or more fourth screen apertures 411 formed within and extending through the fourth screen 404.

The fourth base 402 has a fourth bottom 412 at a first end, and a fourth wall 414 extends from the fourth bottom 412. A fourth wall 414 of the fourth base 402 extends from the fourth bottom 412 at least partly along a fourth central axis 416. Near a second end of the fourth base 402 that is opposite to its first end, the outer surface of the fourth wall 414 includes a fourth attachment section 418. The fourth attachment section 418 is threaded.

As shown in FIG. 4A and FIG. 4B, the removable fourth screen 404 is porous, permitting the content material in the fourth reservoir 410 to pass through and to exit the fourth base 402. As shown in FIG. 4B, the fourth screen 404 includes a fourth sealing ledge 420 that is adapted to provide a snap fit friction fit for securely holding the fourth screen 404 within the fourth base 402.

The fourth screen 404 is detachable from and sized to fit within the fourth base 402. The fourth screen 404 includes a fourth perimeter lip 422. An additional fourth internal screen supporting feature 424 of the fourth base 402 extends from the internal surface of the fourth base wall 414 towards the fourth central axis 416, and the fourth perimeter lip 422 of the fourth screen 404 is correspondingly shaped to be capable of resting on top of the fourth internal screen supporting feature 424. The fourth internal screen supporting feature 424 is preferably a ring-shaped base internal ledge that extends towards the fourth central axis 416.

It is understood that the fourth cover 408 is sized and shaped such that, in a fourth preferred embodiment of the method of the invention, a fourth lower lip 426 of the fourth cover 408 is not positioned sufficiently proximate to a fourth side ledge 428 of the fourth base 402 to enable transfer of force from the fourth cover 408 and to the fourth side ledge 428 when force is being transferred from the fourth cover 408 to the fourth sealing plate 406. The fourth container 400 is thus shaped such that compressive force may be transferred from the fourth cover 408 to the fourth sealing plate 406 without substantive limitation by interference between the fourth side ledge 428 of the fourth base 402 and the fourth cover 408.

As shown in FIG. 4A and FIG. 4B, the fourth sealing plate 406 is adapted to sit upon the fourth screen 404 and to substantively inhibit exit of content material from within the fourth reservoir 410. A fourth seal is thereby generated between an external perimeter area of the fourth sealing plate 406 and an external perimeter area of the fourth screen 404 and the fourth seal is supported by a compressive force transferred from the fourth cover 408 to the fourth sealing plate 406. The compressive force received by the fourth sealing plate 406 from the fourth cover 408 is substantively transferred through the fourth screen 404 and to the fourth base 402. The fourth sealing plate 406 and the fourth screen 404 preferably present a substantively equivalent external diameter along a plane normal to the fourth central axis 416.

The fourth sealing plate 406 forms a substantively hermetic sealing that completely or partially inhibits exit of the content material from the fourth container 400. The fourth sealing plate 406 is adapted to rest upon the fourth perimeter lip 422 of the fourth screen 404 and it upon the fourth internal screen supporting feature 424 of the fourth base 402.

As shown in FIG. 4A and FIG. 4B, the fourth sealing plate 406 also includes a fourth handle 430 that enables a user to manipulate and separate the fourth sealing plate 406 from the fourth screen 404 and the fourth base 402.

As shown in FIG. 4A and FIG. 4B, the fourth cover 408 is adapted to direct force against the fourth sealing plate 406 and toward the fourth base 402 via a fourth cover pressuring feature 432, and thereby to substantively seal the content material in the fourth reservoir 410. The fourth cover pressuring feature 432 is a portion of the fourth cover 408. The fourth cover 408 further includes a fourth cover attachment feature 434 adapted to detachably couple with the fourth base attachment section 418. As shown in FIG. 4A and FIG. 4B, the fourth cover attachment feature 434 may be tapped. The fourth cover 408 is shaped in combination with the fourth base 402 to fully enclose the fourth sealing plate 406 when the fourth cover 408 and the fourth base 402 are coupled. The fourth cover 408 is further shaped to enclose the fourth handle 430 when the fourth cover 408 and the fourth base 402 are coupled.

Figure 5A:
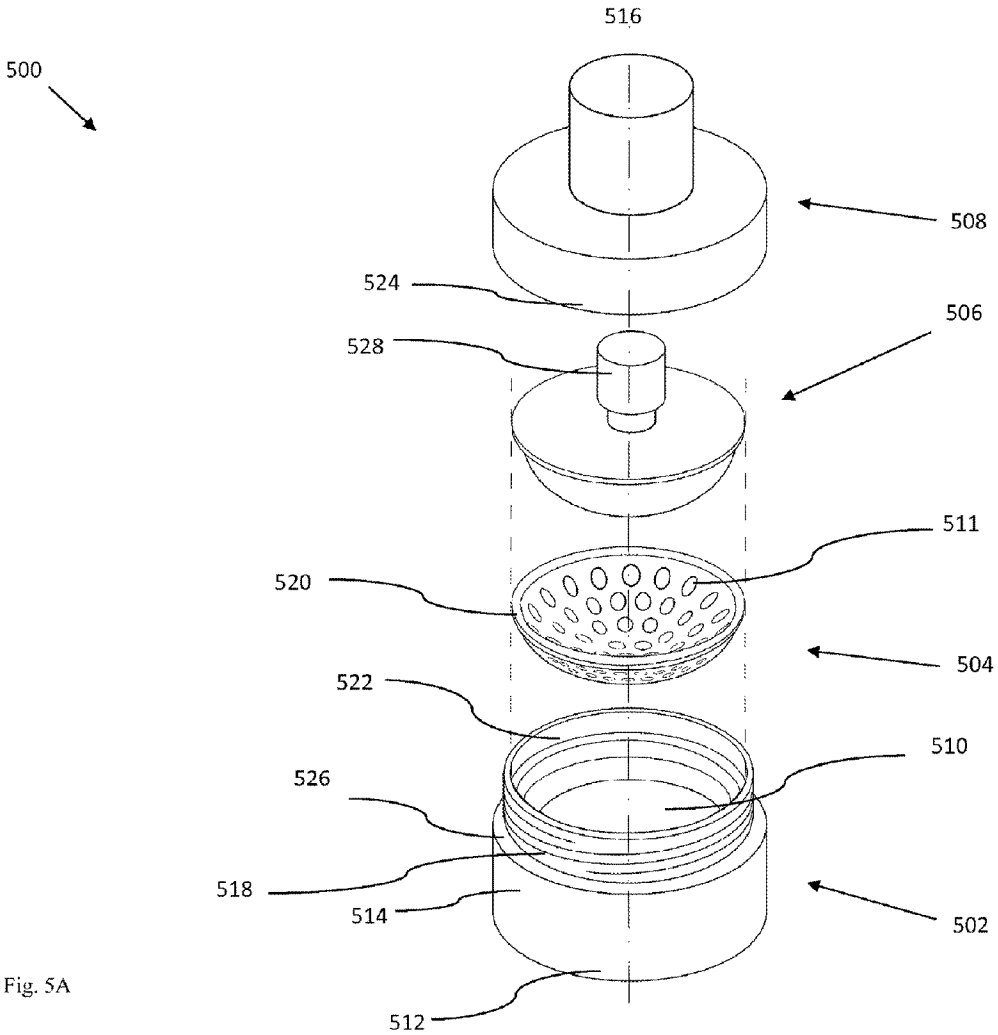
FIG. 5A is a perspective view of a hermetically sealing container according to a fifth embodiment of the invented container, wherein a fifth screen is removable from, and dimensioned for full insertion into, a fifth base.
Figure 5B:
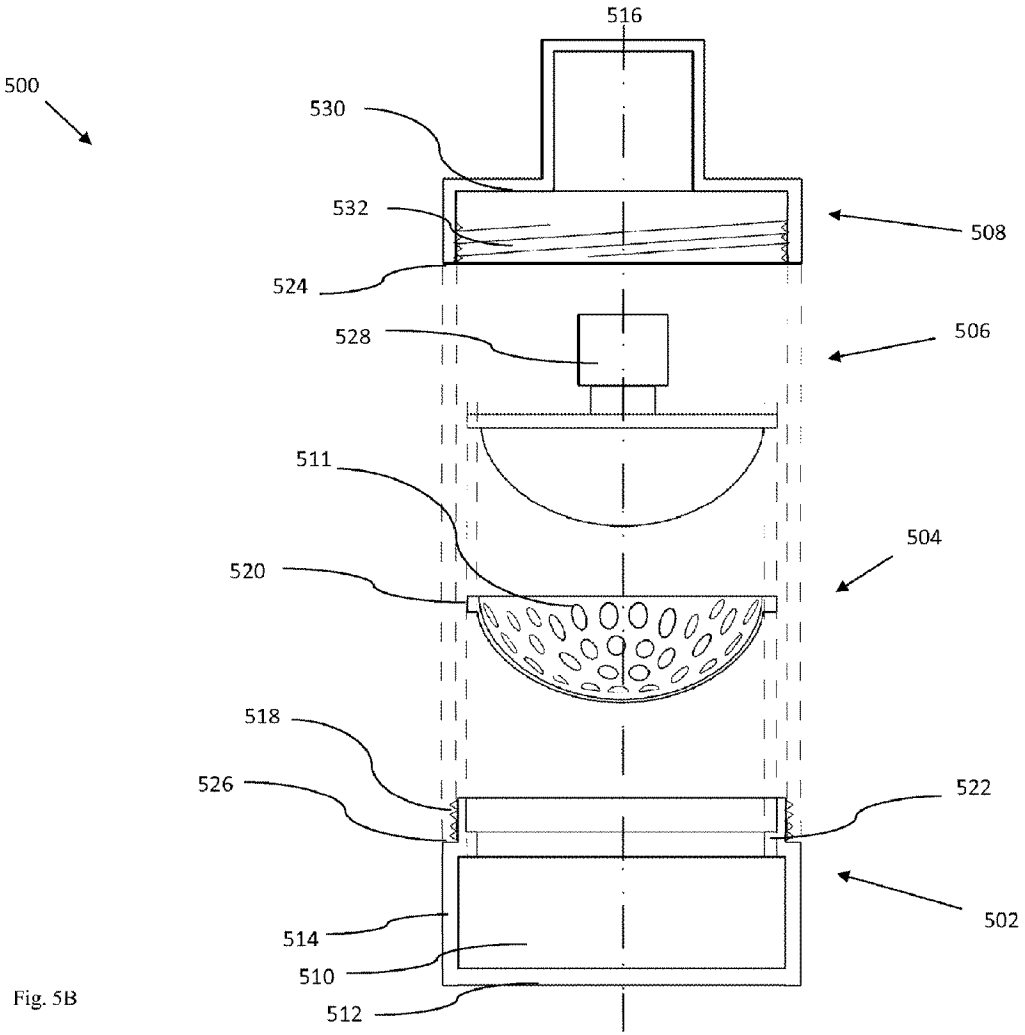
FIG. 5B is a cutaway side-view of the fifth embodiment of FIG. 5A.

Referring now generally to the Figures and particularly to FIG. 5A and FIG. 5B, FIG. 5A and FIG. 5B illustrate a substantively hermetically sealing container 500 according to a fifth embodiment. As shown in FIG. 5A and FIG. 5B, the fifth container 500 includes a fifth base 502, a fifth screen 504, a fifth sealing plate 506, and a fifth cover 508. The fifth container 500 may be or comprise metal, plastic, wood or wood composite, ceramic or other suitable material known in the art in combination or in singularity.

As shown in FIG. 5B, extending from the fifth internal surface of the fifth base 502, the fifth base 502 defines a fifth reservoir 510, wherein content material of the fifth container 500 is stored. Fluids and sufficiently small particulates may pass through the fifth screen 504, and thereby enter and exit the fifth reservoir 510, through one or more fifth screen apertures 511 formed within and extending through the fifth screen 504.

The fifth base 502 has a fifth bottom 512 at a first end, and a fifth wall 514 that extends from the fifth bottom 512. The fifth wall 514 extends from the fifth bottom 512 at least partly along a fifth central axis 516. Near a second end of the fifth base 502 that is opposite to its first end, an outer surface of the fifth wall 514 includes a threaded fifth attachment section 518.

As shown in FIG. 5A and FIG. 5B, the fifth screen 504 is porous, permitting the content material in the fifth reservoir 510 to pass through and from within the fifth base 502.

The fifth screen 504 is sized to fit within the fifth base 502, and includes a fifth perimeter lip 520. A fifth internal screen supporting feature 522 of the fifth base 502 extends from the internal surface of the fifth base wall 514 towards the fifth central axis 516. The fifth perimeter lip 520 is correspondingly shaped to be capable of resting on top of the fifth internal screen supporting feature 522 as part of the fifth container 500. The fifth internal screen supporting feature 522 is preferably a ring-shaped base internal ledge extending towards the fifth central axis 516.

As shown in FIG. 5A and FIG. 5B, the fifth sealing plate 506 is adapted to sit upon the fifth screen 504 and to substantively inhibit exit of the content material from within the fifth reservoir 510. The fifth sealing plate 506 is detachably pressed by the fifth cover 508 against the fifth base 502 to form a at least partially hermetic sealing that at least substantively inhibits exit of the content material from the fifth container 500. The fifth sealing plate 506 is adapted to rest upon the fifth perimeter lip 520.

It is understood that the fifth cover 508 is sized and shaped such that, in a fifth preferred embodiment of the method of the invention, a fifth lower lip 524 of the fifth cover 508 is not positioned sufficiently proximate to a fifth side ledge 526 of the fifth base 502 to enable transfer of force from the fifth cover 508 and to the fifth side ledge 526 when force is being transferred from the fifth cover 508 to the fifth sealing plate 506. The fifth container 500 is thus shaped such that compressive force may be transferred from the fifth cover 508 to the fifth sealing plate 506 without substantive limitation by interference between the fifth side ledge 526 of the fifth base 502 and the fifth lower lip 524 of the fifth cover 508.

As shown in FIG. 5A and FIG. 5B, the fifth sealing plate 506 also includes a fifth handle 528 that enables a user to manually separate the fifth sealing plate 506 from the fifth screen 504 and the fifth base 502.

As shown in FIG. 5A and FIG. 5B, the fifth cover 508 is adapted to direct compressive force against the fifth sealing plate 506 and toward the fifth base 502 via a fifth cover pressuring feature 530, and to thereby substantively seal the content material within the fifth reservoir 510. The fifth cover pressuring feature 530 is a portion of the fifth cover 508. The fifth cover 508 includes a fifth cover tapped attachment feature 532 that is adapted to detachably engage and couple with the fifth base threaded attachment section 518. The fifth cover 508 is shaped in combination with the fifth base 502 to fully enclose the fifth sealing plate 506 when the fifth cover 508 and the fifth base 502 are coupled. The fifth cover 508 is further shaped to enclose the fifth handle 528 when the fifth cover 508 and the fifth base 502 are coupled.

Figure 6:
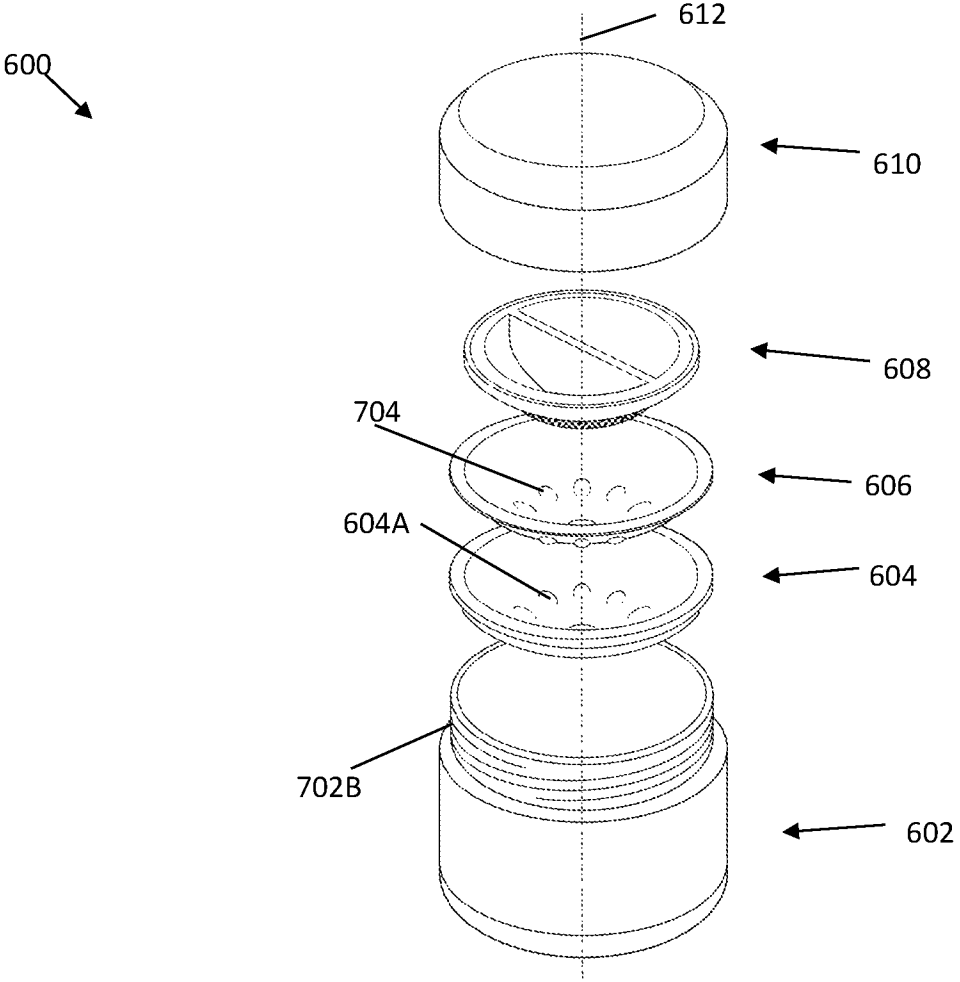
FIG. 6 is an exploded perspective view of a hermetically sealed container structured in accordance with a sixth preferred embodiment the method of the invention and comprising an invented container, wherein the invented container comprises a base, a strainer, a liner, a brush handle assembly and a cover cap.

FIG. 6 is an exploded perspective view of a sixth preferred embodiment the method of the present invention comprising a hermetically sealable invented container 600 (hereinafter, "the sixth container" 600), wherein the sixth container 600 comprises a sixth base 602, a sixth strainer 604, a liner 606, a sixth brush handle assembly 608 and a sixth cover 610, wherein all elements are positionable along a central axis 612 of the sixth container 600. It is understood that the liner 606 may be optionally removed and discarded from the sixth container 600.

One or more elements of the sixth container 600 may comprise in whole or in part Polyurethane, nylon, one or more thermoplastic elastomers, Polyvinylchloride, and/or other suitable materials known in the art in singularity or in combination. More particularly, the base 602 may comprise Polyethylene terephthalate glycol modified, the sixth strainer 604 and the sixth brush 608 and/or the sixth cover 610 may comprise polypropylene, and/or the liner 606 may comprise polyethylene.

Figure 7B:
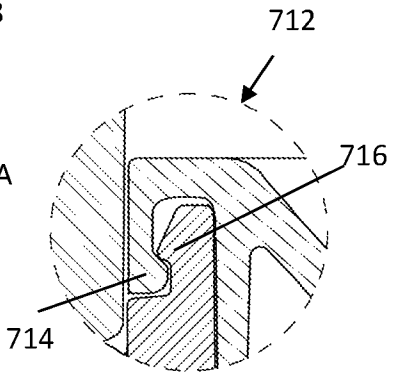
FIG. 7B is an enlarged detail illustration of the container assembly of FIG. 7A showing a snap-on mechanism adapted for securely connecting together the base with the strainer 604.
Figure 7A:
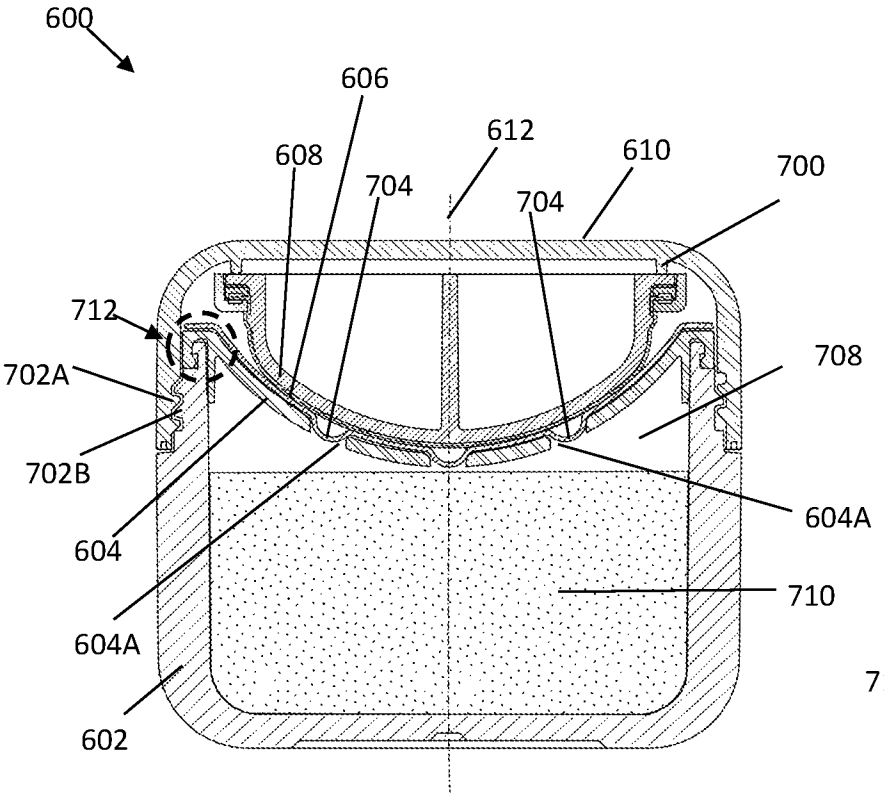
FIG. 7A is a cutaway side-view of the invented container assembly of FIG. 6.

FIG. 7A is a cutaway elevation side view of the sixth container 600 of FIG. 6 in an assembled and sealed state, wherein the sixth container 600 comprises the sixth base 602, the sixth strainer 604, the liner 606, the sixth brush handle assembly 608 and the sixth cover 610 wherein the sixth cover 610 optionally includes a cover pressure ring 700. In the sealed state, the cover pressure ring 700 delivers a compressive force to the sixth brush handle assembly 608, wherein the dominant vector of this compressive force has a direction parallel with the central axis 612 and downward from the sixth cover 610 towards the sixth base 602. This compressive force is then largely transferred from the sixth brush handle assembly 608 and to the liner 606, or alternatively to the sixth strainer 604 when the liner 606 has been removed from the sixth container 600. The sixth strainer 604 receives compressive force from either the liner 606 or directly from the sixth brush handle assembly 608.

It is understood that the compressive force may be generated by engagement of a cover tapped section 702A of the sixth cover 610 and a base threaded section 702B of the sixth base 602 whereby a user may manually drive the sixth cover 610 along the central axis 612 and downwards toward the sixth base 602.

Additionally, the sixth strainer 604 contains a plurality of screen apertures 604A and the liner 606 contains a plurality of dimples 704, wherein preferably each of the plurality dimples 704 extend into or through one of the plurality of screen apertures 604A to seal a sixth base volume 706 within the sixth base 602 against leakage from the sixth base volume 706.

The sixth base 602 of the sixth container 600 is holding a material 710 wherein the material 710 is occupying at least a portion of the base volume 708. The material 710 may be or comprise a liquid, a semi-liquid, a solution, a cream, a powder and/or a solid substance.

FIG. 7B is an enlarged detail illustration of the sixth container 600 of FIG. 7A showing a snap-on mechanism 712 that is adapted for securely coupling together the base 602 with the strainer 604. The snap-on mechanism 712 includes a strainer coupling element 714 and a base coupling element 716.

Figure 7C:
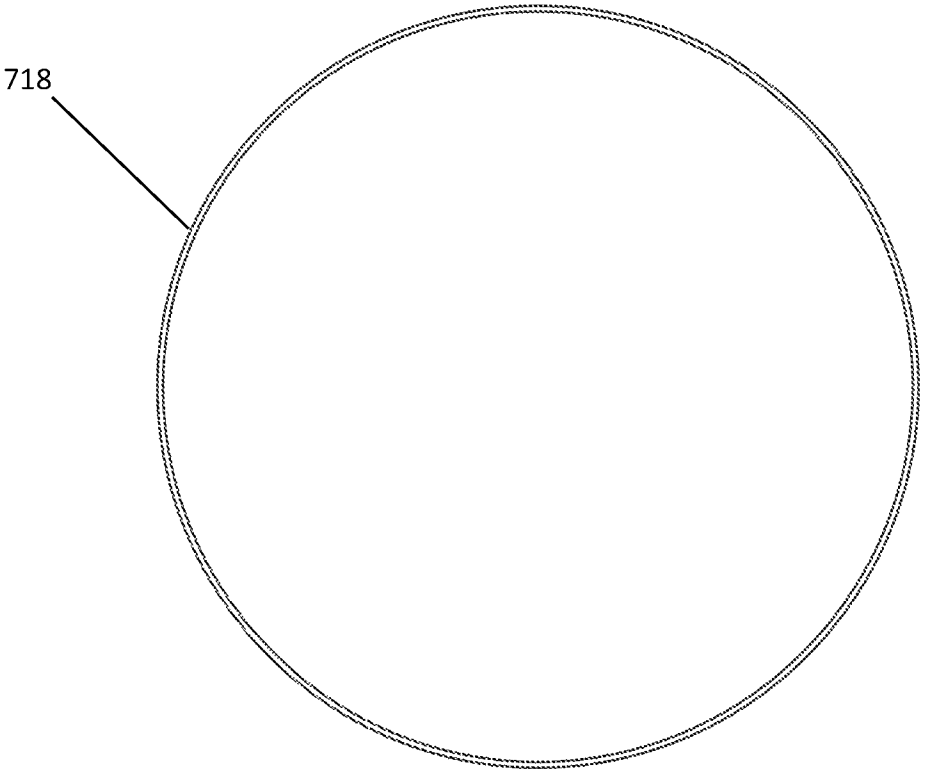
FIG. 7C is an O-ring that may be optionally included in the container assembly of FIG. 7A.

FIG. 7C is an O-ring 718 that may be optionally included in the snap-on mechanism 712 of FIG. 7B. The O-ring 718 may comprise in whole or in part silicone rubber or equivalent other suitable materials known in the art in singularity or in combination.

Figure 7E:
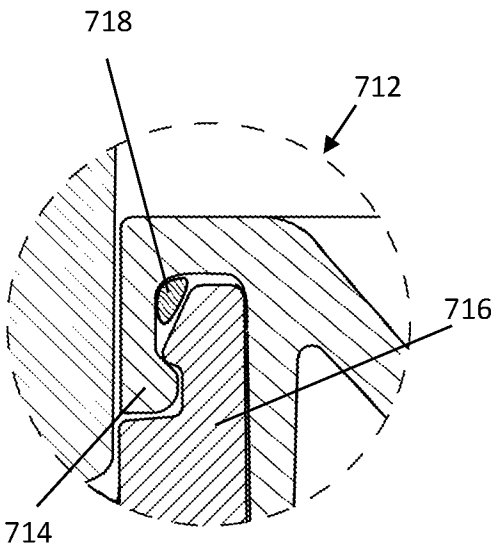
FIG. 7E is a detailed cut-away side view of the container assembly of FIG. 7A and the O-ring of FIG. 7C wherein the O-ring is engaged within the container assembly.
Figure 7D:
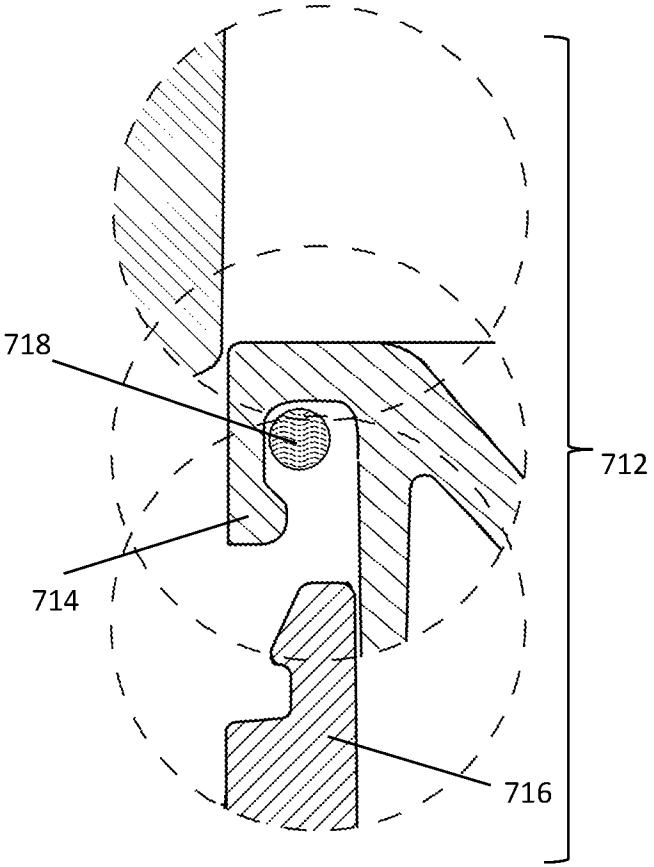
FIG. 7D is an exploded detailed cut-away side view of the container assembly of FIG. 7A and the O-ring of FIG. 7C.

FIG. 7D is an exploded detailed cut-away side view of the snap-on mechanism 712 of FIG. 7B and including the optional the O-ring 718 of FIG. 7C.

FIG. 7E is a detailed cut-away side view of the container assembly of FIG. 7A and the O-ring 718 of FIG. 7C wherein the O-ring 718 is engaged within the snap-on mechanism 712 that is adapted for securely coupling together the sixth base 602 with the sixth strainer 604. The snap-on mechanism 712 includes the strainer coupling element 714 and the base coupling element 716. The O-ring 718 impedes or at least inhibits seepage of the material 710 from the base volume 708.

Figure 7F:
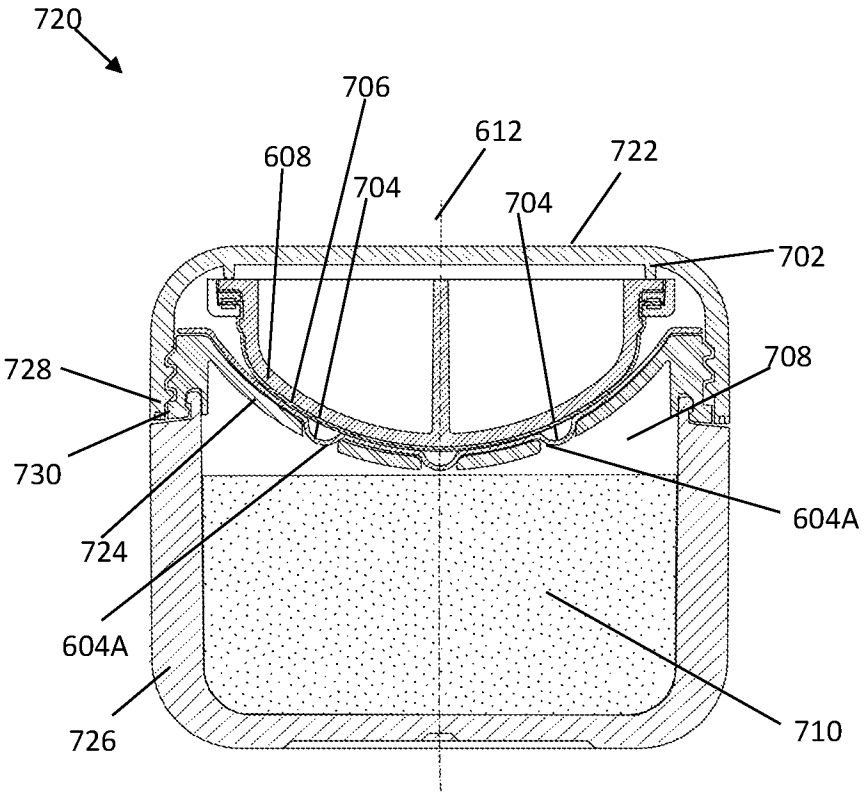
FIG. 7F is a cut away side view of a variation of the container assembly of FIG. 7A wherein the cover engages directly with the strainer thereof.

FIG. 7F is a cut away side view of a seventh embodiment of the present invention 720 (hereinafter, seventh container" 720) wherein a seventh cover 722 engages directly with a seventh strainer 724, thereof wherein a seventh base 726 is detachably coupled to seventh strainer 724. The seventh strainer 724 receives compressive force from either the liner 606 or directly from the sixth brush handle assembly 608. It is understood that the compressive force may be generated by engagement of a tapped cover section 728 of the seventh cover cap 722 and a strainer threaded section 730 of the seventh strainer 724 whereby a user may manually drive the seventh cover cap 722 along the central axis 612 and downwards toward the seventh strainer 724.

Figure 8A:
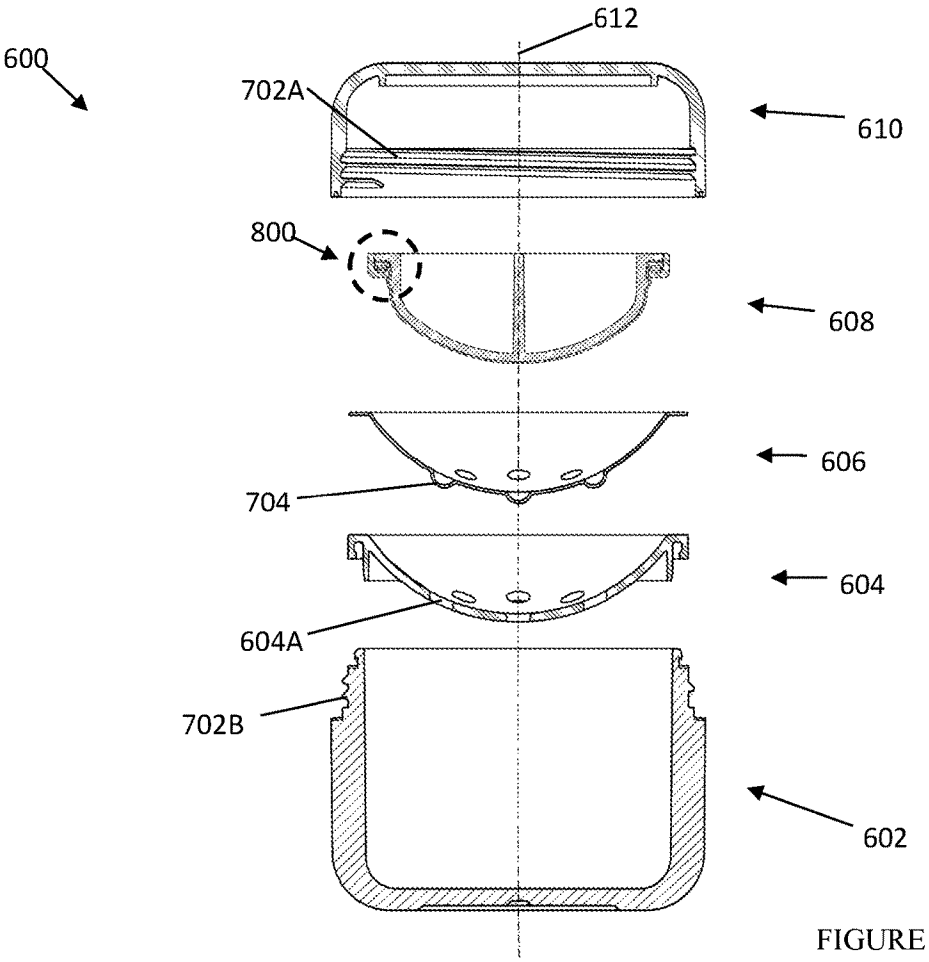
FIG. 8A is an exploded cutaway side-view of the invented container of FIG. 6, wherein the container comprises the base, the strainer, the liner, the brush handle assembly and the cover cap.

FIG. 8A is an exploded cutaway side-view of the sixth container 600 of FIG. 6, wherein the sixth container 600 optionally further comprises a snap-on mechanism handle assembly coupling feature 800.

Figure 8B:
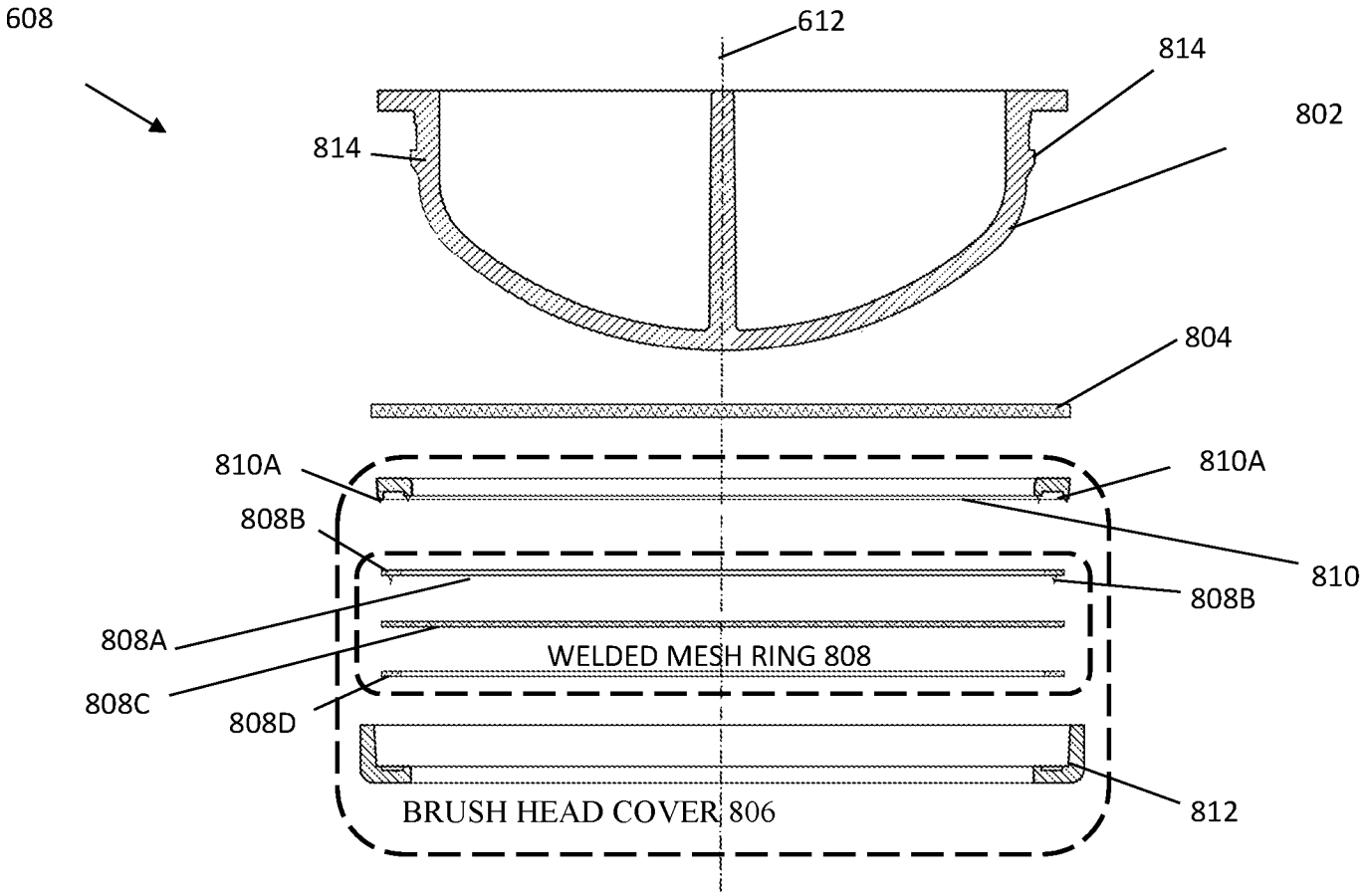
FIG. 8B is an exploded cutaway side-view of the brush handle assembly of FIG. 6, wherein the brush handle assembly, comprises a brush handle, an absorbent pad, an internal ring, an upper mesh weld ring with a protruding ultrasonic rib which will penetrate the non-woven mesh fabric, a lower mesh weld ring, and an external ring.

FIG. 8B is an exploded cutaway side-view of the sixth brush handle assembly 608 of FIG. 6, wherein the sixth brush handle assembly 608 comprises a brush frame 802, an absorbent pad 804, and a brush head cover 806. For clarity of explanation, attention is drawn to the side view of the assembled sixth brush head cover 806 of FIG. 9B. {In FIG. 8B, there is an unlabeled arrow on the right side of the diagram. It may have been the old arrow for the label welded mesh ring 808, but it is no longer necessary.}

Figure 9A:
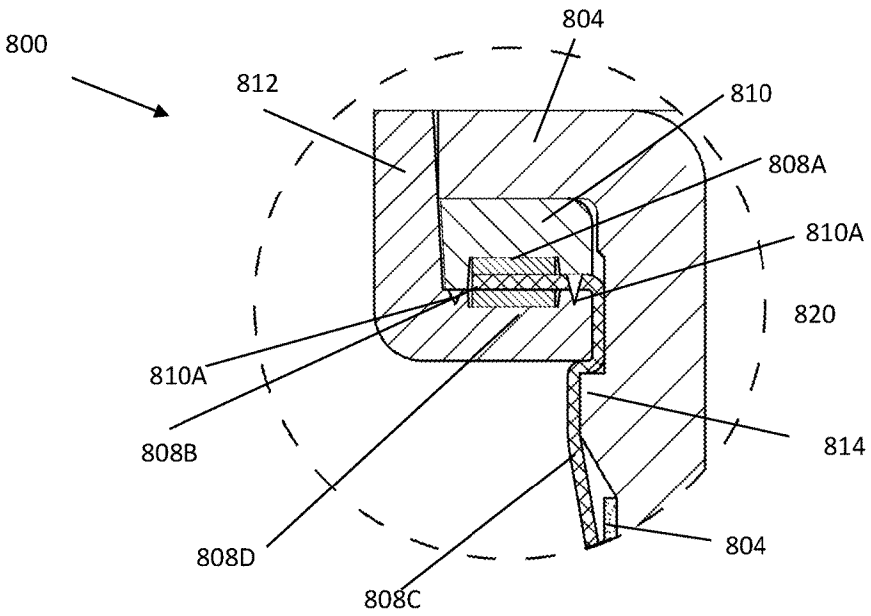
FIG. 9A is an enlarged detailed illustration of the snap fitting of the brush handle assembly of FIG. 8A.

The brush head cover 806 comprises a welded mesh ring 808, an internal ring 810, and an external ring 812. The welded mesh ring 808 fits within the external ring 812 and is captured by a coupling of the internal ring 810 and the external ring 812 as shown in FIG. 9A.

The welded mesh ring 808 comprises an upper mesh weld ring 808A having a first plurality of protruding ultrasonic ribs 808B which will penetrate a non-woven mesh fabric 808C, and a lower mesh weld ring 808D. The welded mesh ring 808 is coupled by application of ultrasonic energy to the first plurality of protruding ultrasonic ribs 808B as the first plurality of protruding ultrasonic ribs 808B extend through the non-woven mesh fabric 808C and are in contact with, and optionally pressed against, the lower mesh weld ring 808D, whereby the welded mesh ring 808 is formed by this welding action. {In FIG. 9A, item 808C has an arrow pointing towards it, but the label is missing on the diagram.}

The brush head cover 806 is formed by application of ultrasonic energy to a second plurality of protruding ultrasonic cover ribs 810A of the internal ring 810 as the inner ring of the second plurality of protruding ultrasonic cover ribs 810A extend through the non-woven mesh fabric 808C and the plurality of protruding ultrasonic cover ribs 810A are in contact with, and optionally pressed against, the external ring 812, whereby the welded mesh ring 808 is captured between the, internal ring 810 and the external ring 812 and the brush head cover 806 is formed by this welding of the plurality of protruding ultrasonic cover ribs 810A with the external ring 812.

A capture ridge 814 of the base frame 802, wherein the brush head cover 806 is elastically stretched to pass over the capture ridge 814 while the absorbent pad 804 is disposed between the base frame 802 and the brush head cover 806, whereby the absorbent pad 804 is removably secured between the base frame 802 and the brush head cover 806. The capture ridge 814 is a circumferential feature that is formed substantively about an exterior of the brush frame 802.

FIG. 9A is an enlarged detailed illustration of a snap-on mechanism handle assembly coupling feature 800 of the sixth brush handle assembly 608 of FIG. 8A. The snap-on mechanism handle assembly coupling feature 800 includes the upper mesh weld ring 810, the non-woven mesh fabric 808C, and a lower mesh weld ring 812 that ultrasonically welded together to form the brush head cover 806. {Item 808C is not labeled in FIG. 9A}

The brush head cover 806 is adapted for securely connecting together elements of the sixth brush handle assembly 608, wherein the brush frame 802 functions as a platform upon which the absorbent pad 804 is positioned and supported. When the absorbent pad 804 is disposed between the brush head cover 806 and the brush frame 802 as the brush head cover 806 is stretched over the capture ridge 814 of the brush handle 804, whereupon the absorbent pad 806 is securely locked into place once the brush head cover 806 is positioned above the capture ridge 814 of the brush handle 804. It is understood that the absorbent pad 806 may be or comprise cotton, sponge, or suitable material known in the art in singularity or in combination.

Figure 9B:
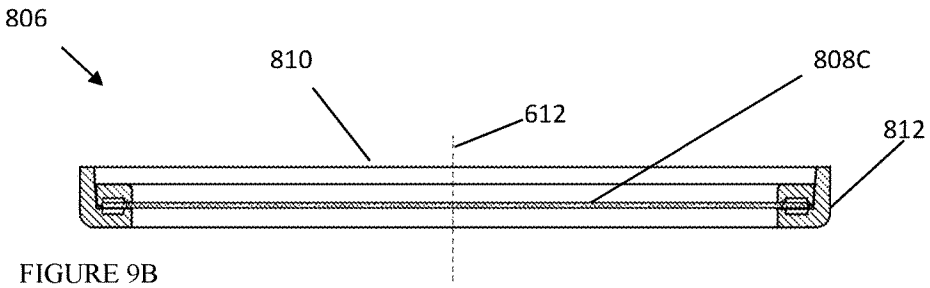
FIG. 9B is a cutaway side view of the assembled brush head cover of FIG. 8B.

FIG. 9B is a cutaway elevation side view of the brush head cover 806.

Figure 10A:
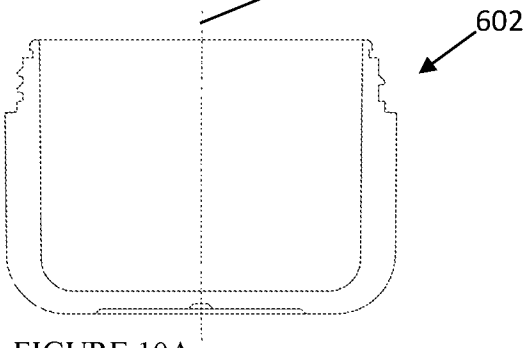
FIG. 10A is a cutaway side view of the base of FIG. 6.

FIG. 10A is a cutaway elevation side view of the sixth base 602.

Figure 10D:
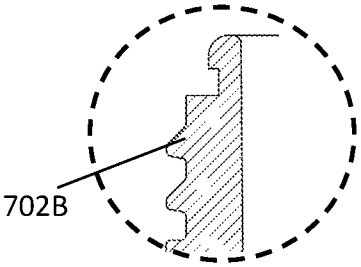
FIG. 10D is a detail drawing of the base of FIG. 6.
Figure 10B:
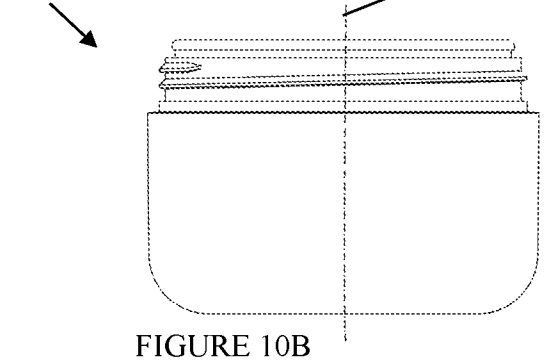
FIG. 10B is an elevation side view of FIG. 6.

FIG. 10B is an elevation side view of the sixth base 602.

Figure 10C:
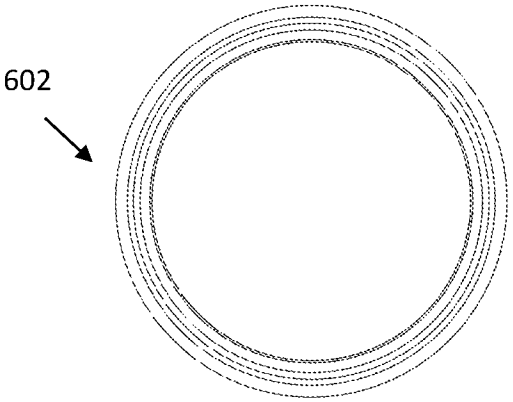
FIG. 10C is, a top view of FIG. 6.

FIG. 10C is a top plan view of the sixth base 602 that includes the base threaded section 702B.

FIG. 10D is a detail drawing of a cutaway side view of the sixth base 602.

Figure 11A:
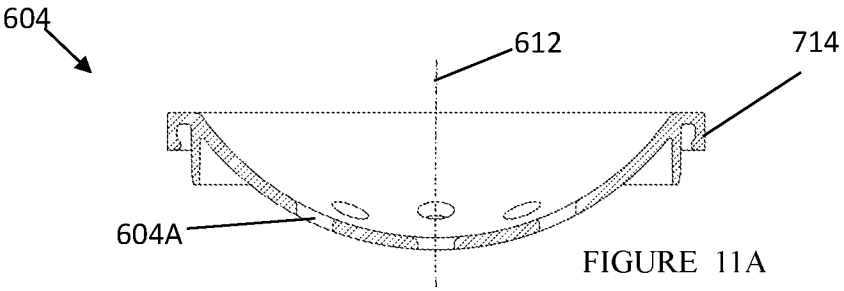
FIG. 11A is a cutaway side view of the strainer of FIG. 6.

FIG. 11A is a cutaway elevation side view of the sixth strainer 604 of FIG. 6 and presents the strainer snap-on feature 714.

Figure 11B:
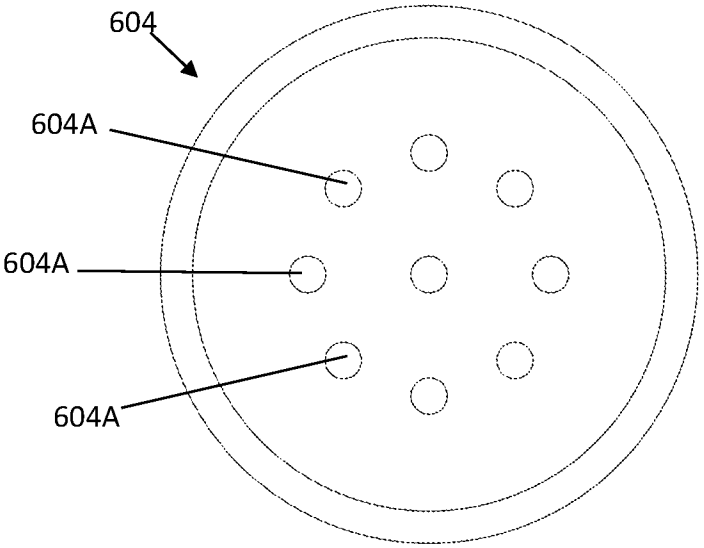
FIG. 11B is a top view of the strainer of FIG. 6.

FIG. 11B is a top plan view of the sixth strainer 604 of FIG. 6.

Figure 11C:
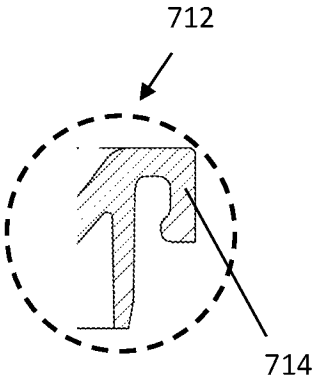
FIG. 11C is a detail drawing of the strainer of FIG. 6.

FIG. 11C is a cutaway detail elevation isolated side view of the strainer element coupling 714 of the sixth strainer 604 of FIG. 7A.

Figure 12A:
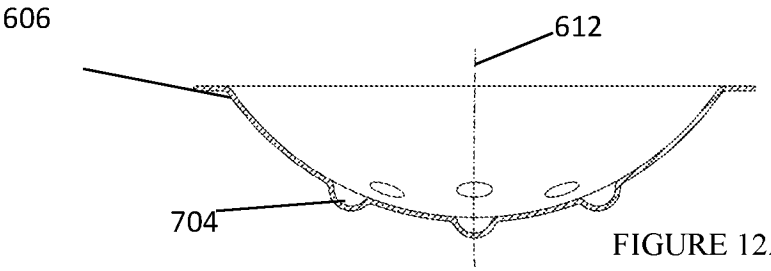
FIG. 12A is an elevation side view of the liner of FIG. 6.

FIG. 12A is a cutaway elevation side view of the liner 606 of FIG. 6 and presenting a view of the plurality of dimples 704.

Figure 12B:
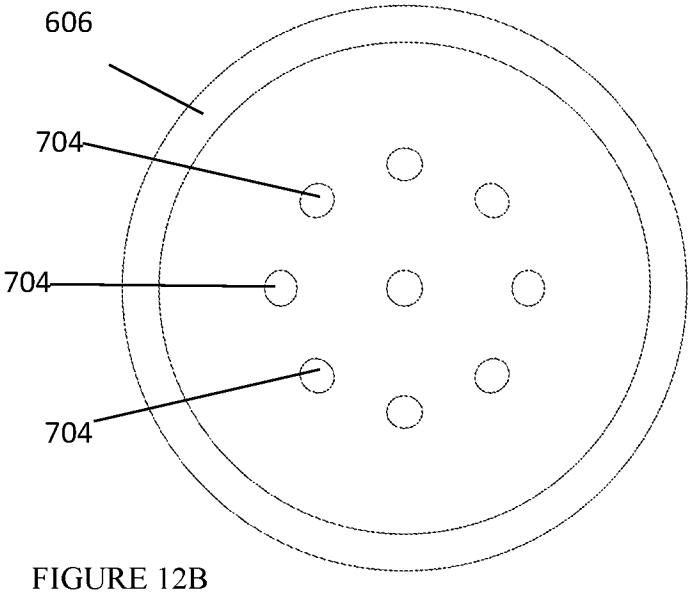
FIG. 12B is a top view of the liner of FIG. 6.

FIG. 12B is a top plan view of the liner 606 of FIG. 6 and presenting a view of the plurality of dimples 704.

Figure 13A:
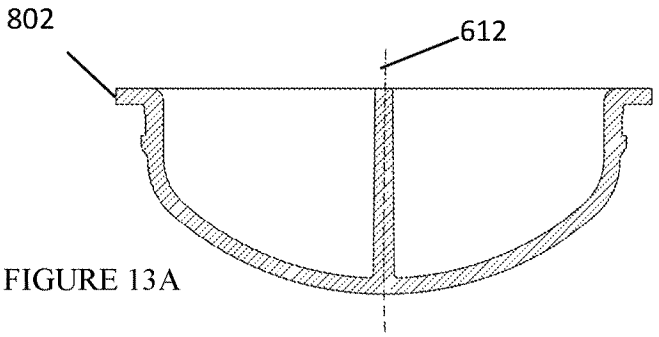
FIG. 13A is a cutaway side view of the brush handle of FIG. 8B.

FIG. 13A is a cutaway elevation side view of the brush frame 802 of FIG. 8B.

Figure 13B:
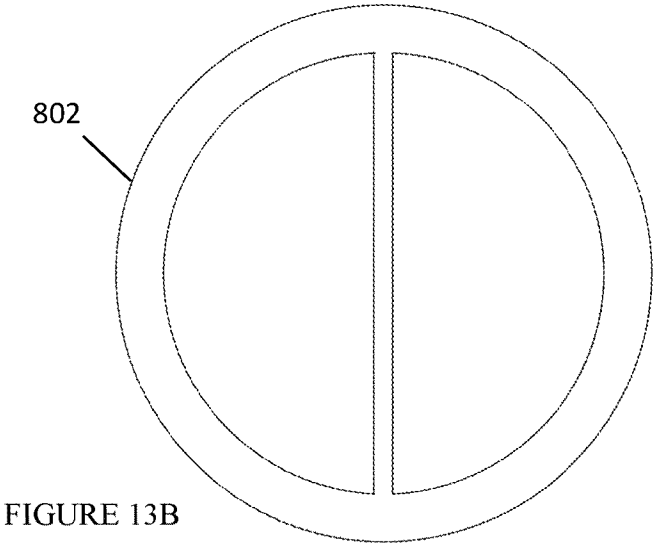
FIG. 13B is a top view of the brush handle of FIG. 8B.

FIG. 13B is a top plan view of the brush frame 802 of FIG. 8B.

Figure 14C:
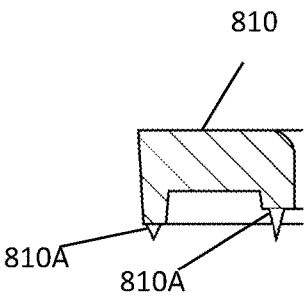
FIG. 14C is a detail drawing of the of the internal ring of FIG. 8B.
Figure 14B:
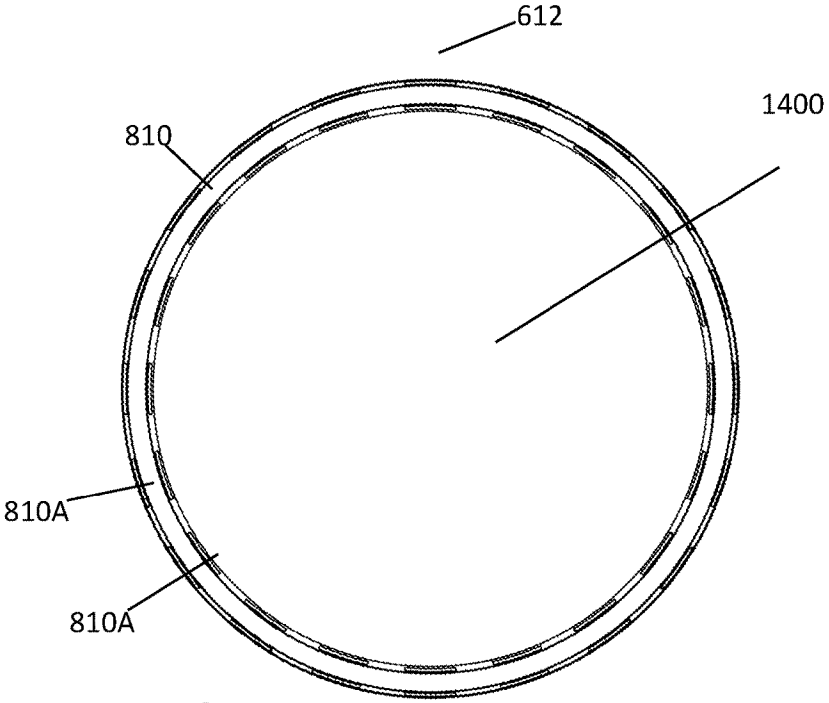
FIG. 14B is a top view of the internal ring of FIG. 8B.
Figure 14A:
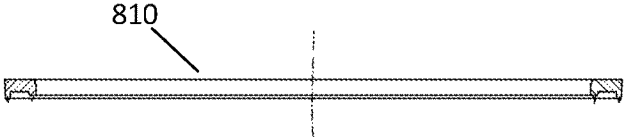
FIG. 14A is a cutaway side view of the internal ring of FIG. 8B.

FIG. 14A is a cutaway elevation side view of the internal ring 810 of FIG. 8B.

FIG. 14B is a top plan view of the internal ring 810 of FIG. 8B that presents a central first aperture 1400 of the internal ring 810.

FIG. 14C is a detail cutaway elevation side view of the internal ring 810.

Figure 15C:
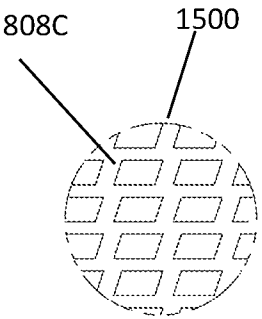
FIG. 15C is a detail drawing of the assembled and welded nylon mesh ring of FIG. 8B.
Figure 15A:
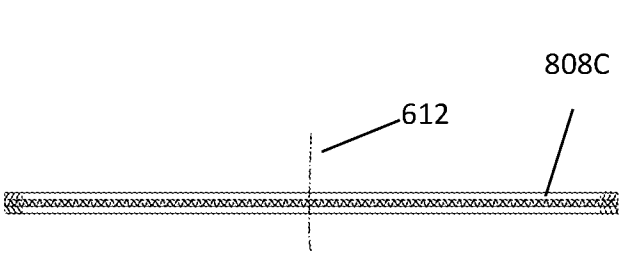
FIG. 15A is a cutaway side view of the assembled and welded nylon mesh ring of FIG. 8B.

FIG. 15A is a cutaway side view of the assembled welded mesh ring 808.

Figure 15B:
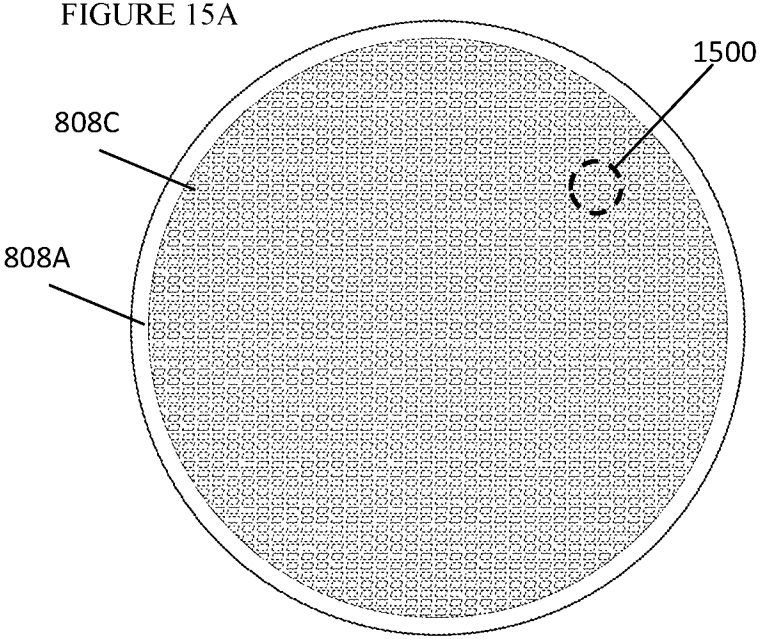
FIG. 15B is a top view of the assembled and welded nylon mesh ring of FIG. 8B.

FIG. 15B is a top plan view of the assembled welded non woven mesh ring 808 and an isolated exemplary section 1500 of the non-woven mesh fabric 808C.

FIG. 15C is a top plan view of the isolated exemplary section 1500 of the non-woven mesh fabric 808C. It is understood that the non-woven mesh fabric 808C may be or comprise nylon or other suitable fabric known in the art.

Figure 16A:
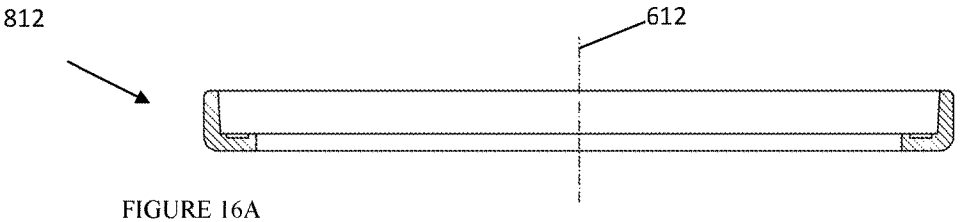
FIG. 16A is a cutaway side view of the external ring of FIG. 8B, wherein it is understood that fully welded assembly part is shown in FIG. 9.

FIG. 16A is a cutaway side view of the external ring 812 of FIG. 8B.

Figure 16B:
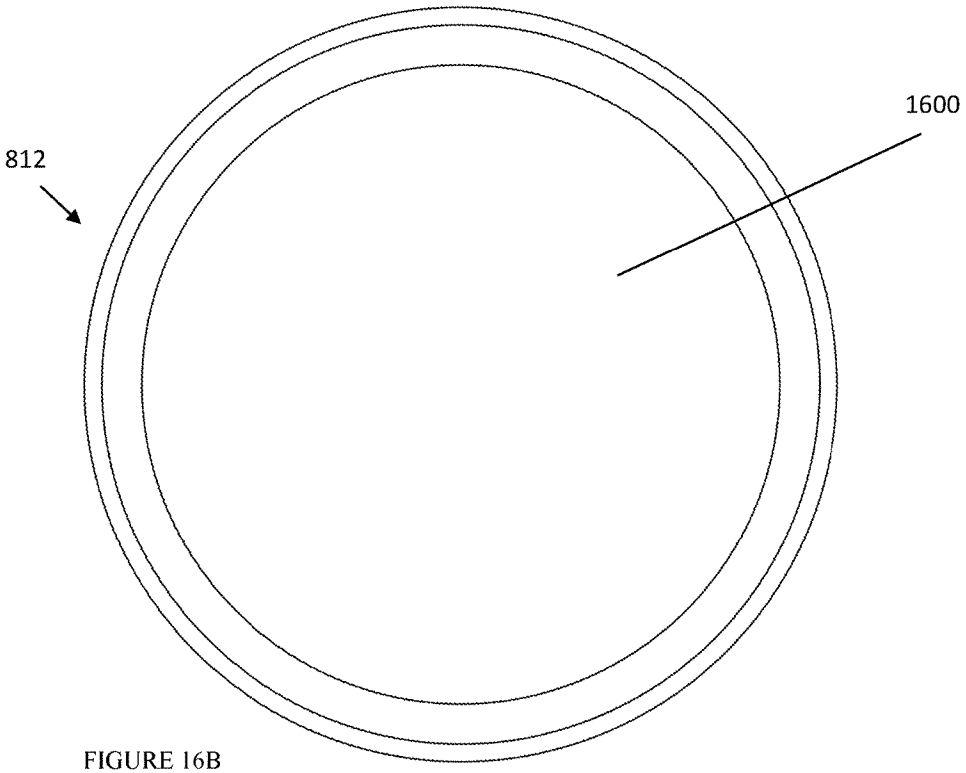
FIG. 16B is a top view of the external ring of FIG. 8B, wherein it is understood that fully welded assembly part is shown in FIG. 9.

FIG. 16B is a top plan view of the external ring 812 of FIG. 8B that presents a central second aperture 1600 of the external ring 812.

Figure 17B:
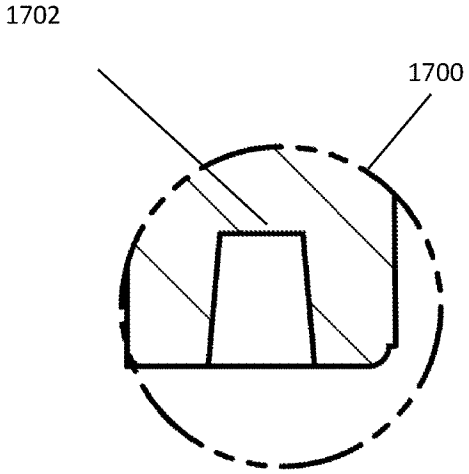
FIG. 17B is a detailed partial cutaway side view of a cover channel of the cover cap of FIG. 6.
Figure 17A:
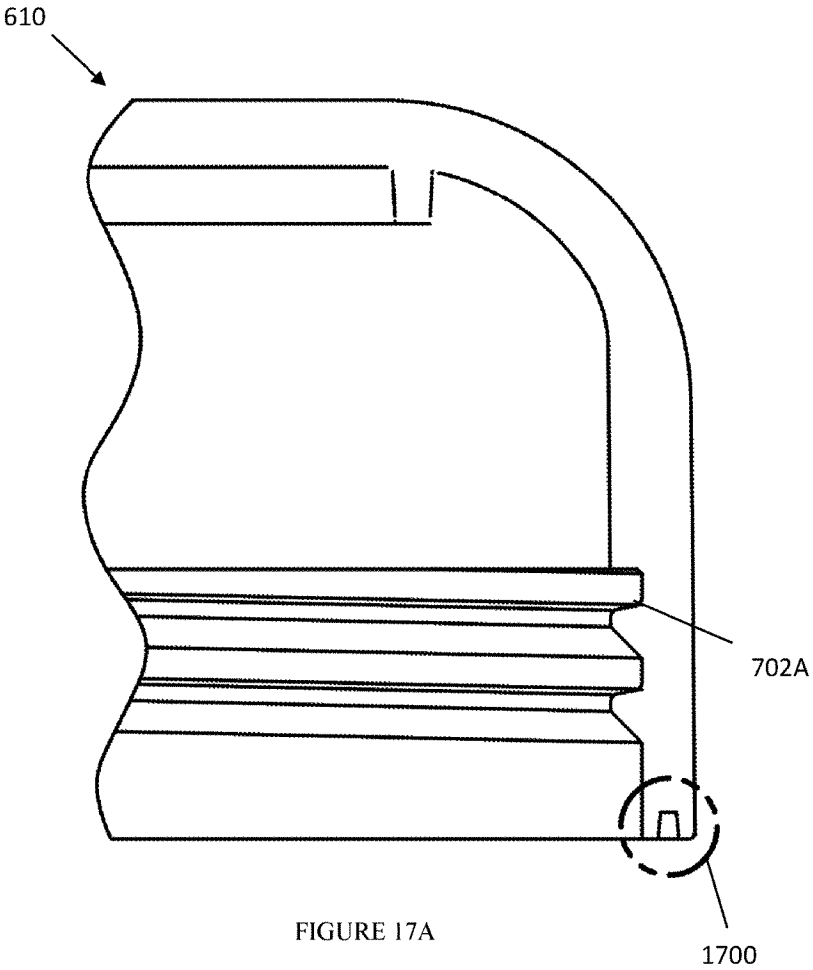
FIG. 17A is a partial cutaway side view of the cover cap of FIG. 6.

FIG. 17A is a partial cutaway side view of the sixth cover 610 of FIG. 8A and that presents an indicated area 1700 centered on a cover channel 1702.

FIG. 17B is a separate partial detailed view of indicated area 1700 and the cover channel 1702. The cover channel 702 is sized, shaped and positioned to straddle an upper lip (not shown) of the base 602.

Figure 17D:
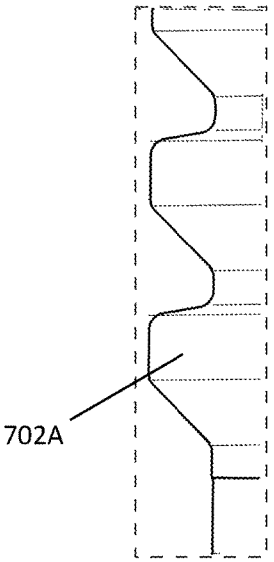
FIG. 17D is a detailed partial cutaway side view of a tapped section of the cover cap of FIG. 6.
Figure 17C:
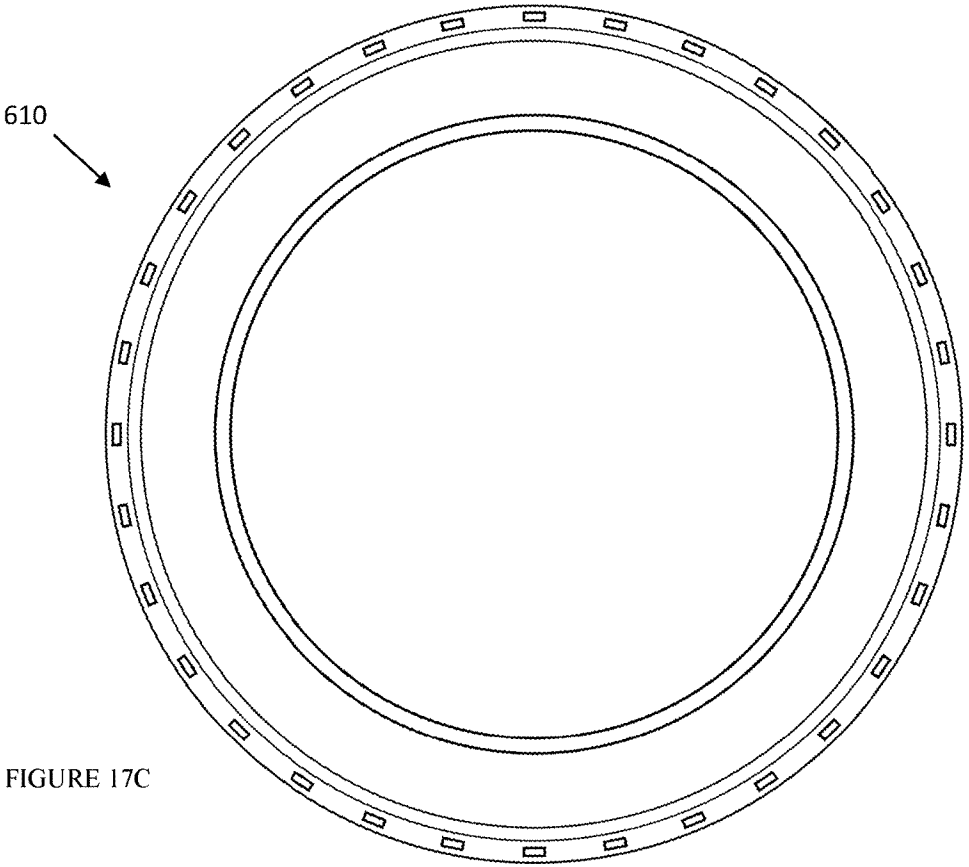
FIG. 17C is a bottom plan view of the cover cap of FIG. 6.

FIG. 17C is a bottom plan view of the sixth cover 610 of FIG. 8A.

FIG. 17D is a separate partial detailed cut away elevation side view of the tapped section 702A of the sixth cover 610 of FIG. 8A.

Figure 18A:
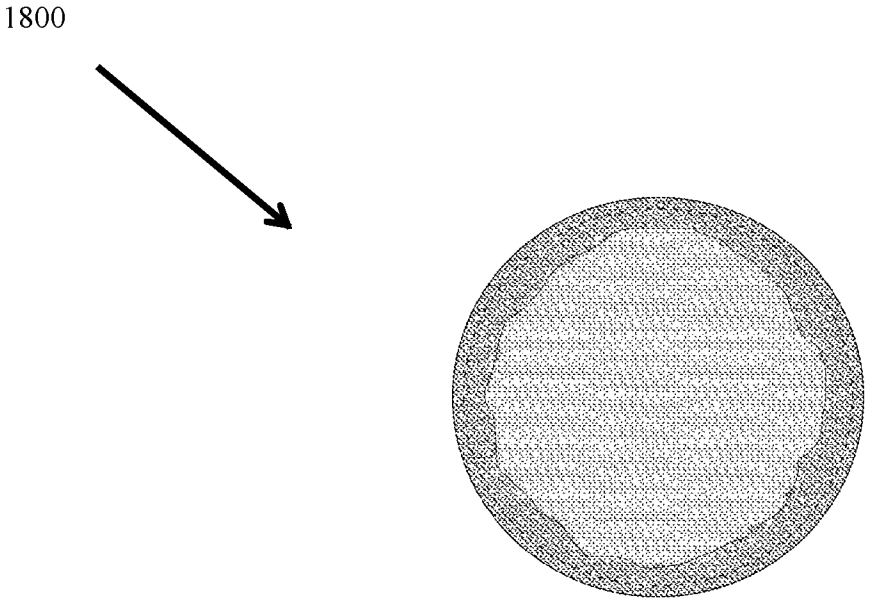
FIG. 18A presents an alternate brush head cover that includes an exemplary second nylon ring.

FIG. 18A presents an alternate brush head cover 1800.

Figure 18B:
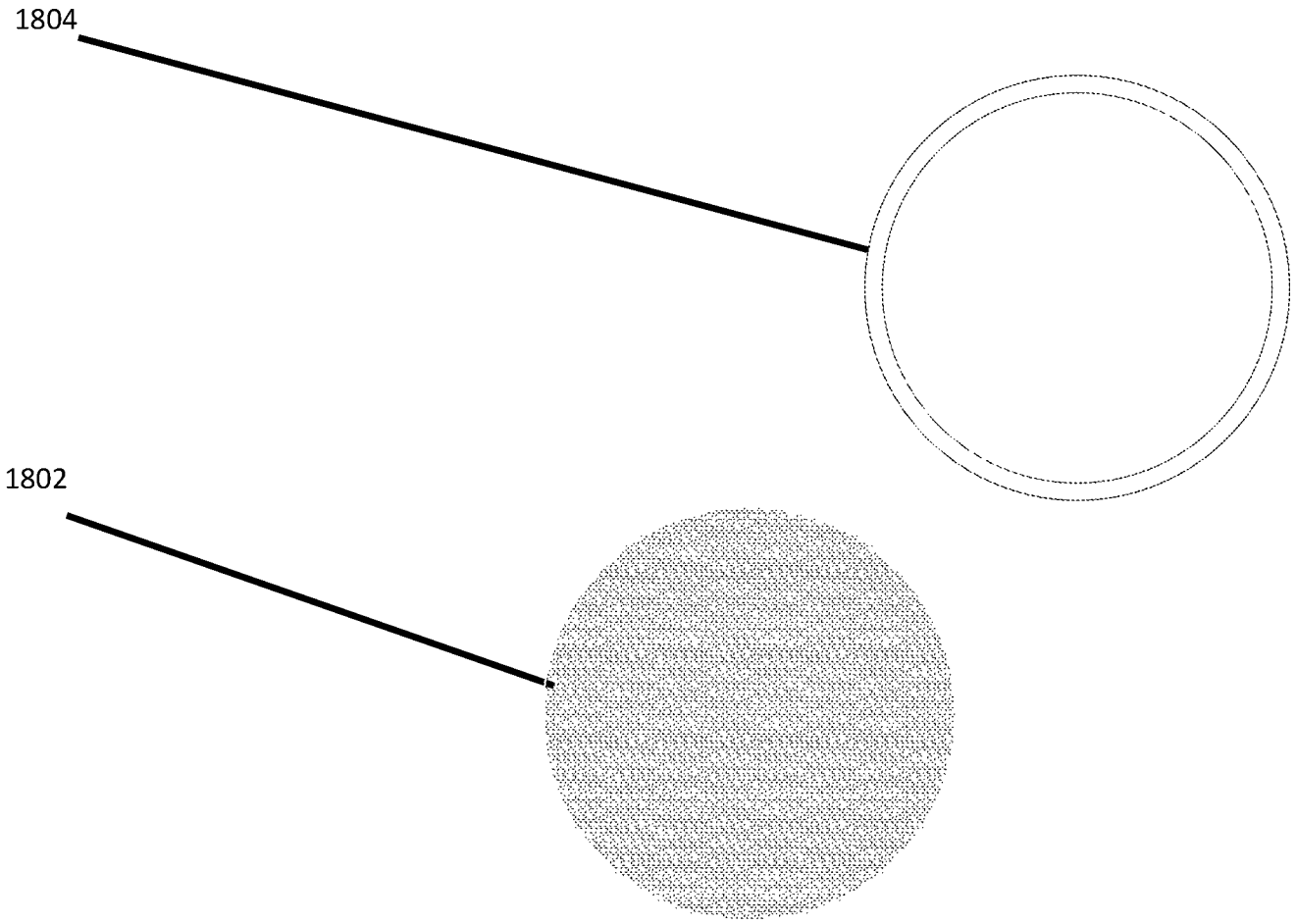
FIG. 18B presents the alternative nylon ring of FIG. 18A and the alternate brush head cover material of mesh fabric of FIG. 18A.

FIG. 18B presents two components of the alternate brush head cover 1800, namely a non-woven mesh fabric 1802 into which a second nylon ring 1804 is sewn into to form the alternate brush head cover 1800.

Figure 18C:
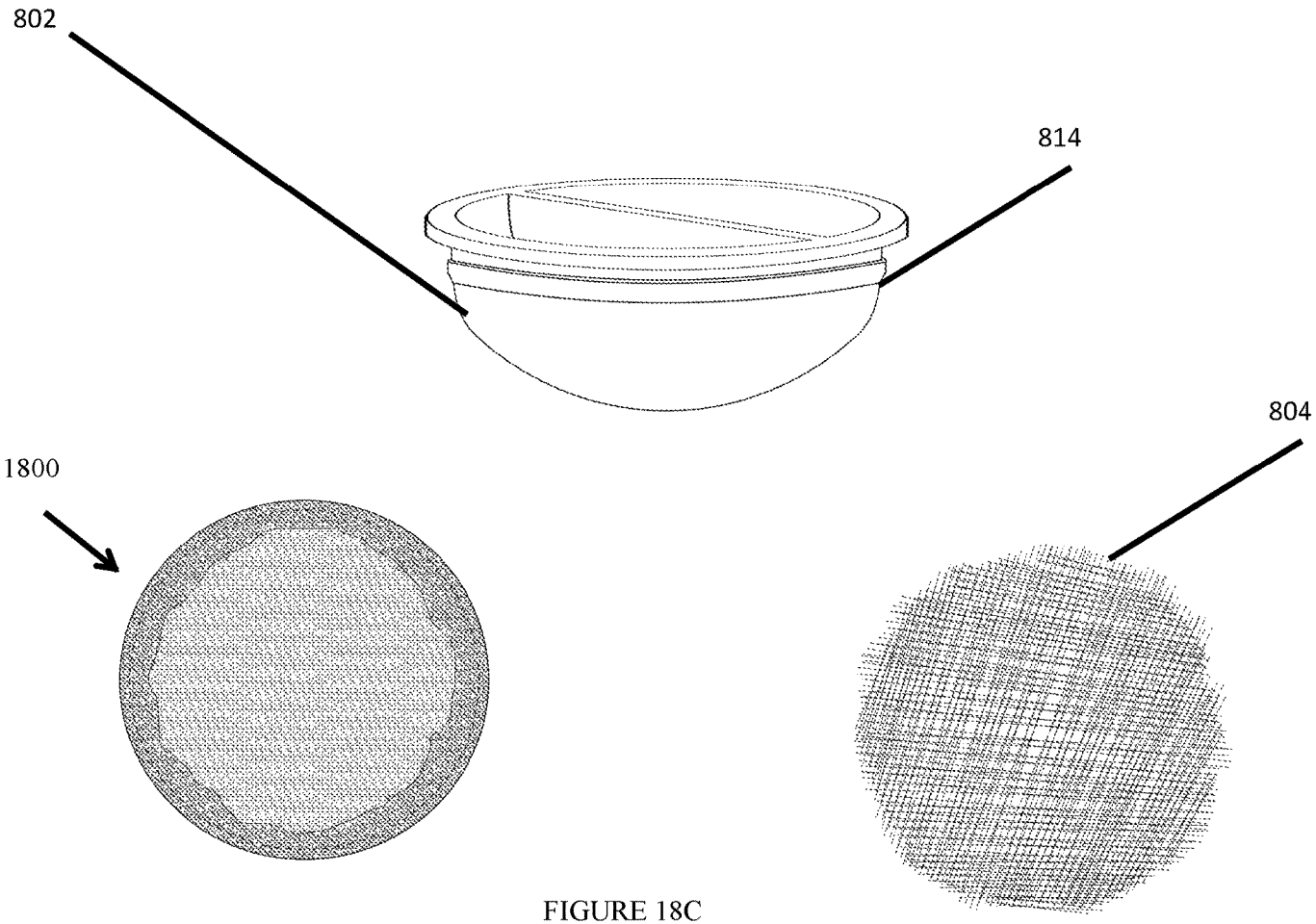
FIG. 18C is a perspective view of the alternate brush head cover of FIG. 18A, the brush frame of FIG. 8B and the absorbent pad of FIG. 8B in an uncoupled state.

FIG. 18C presents the brush frame 802, the absorbent pad 804 and alternate brush head cover 1800 in an uncoupled state.

Figure 18D:
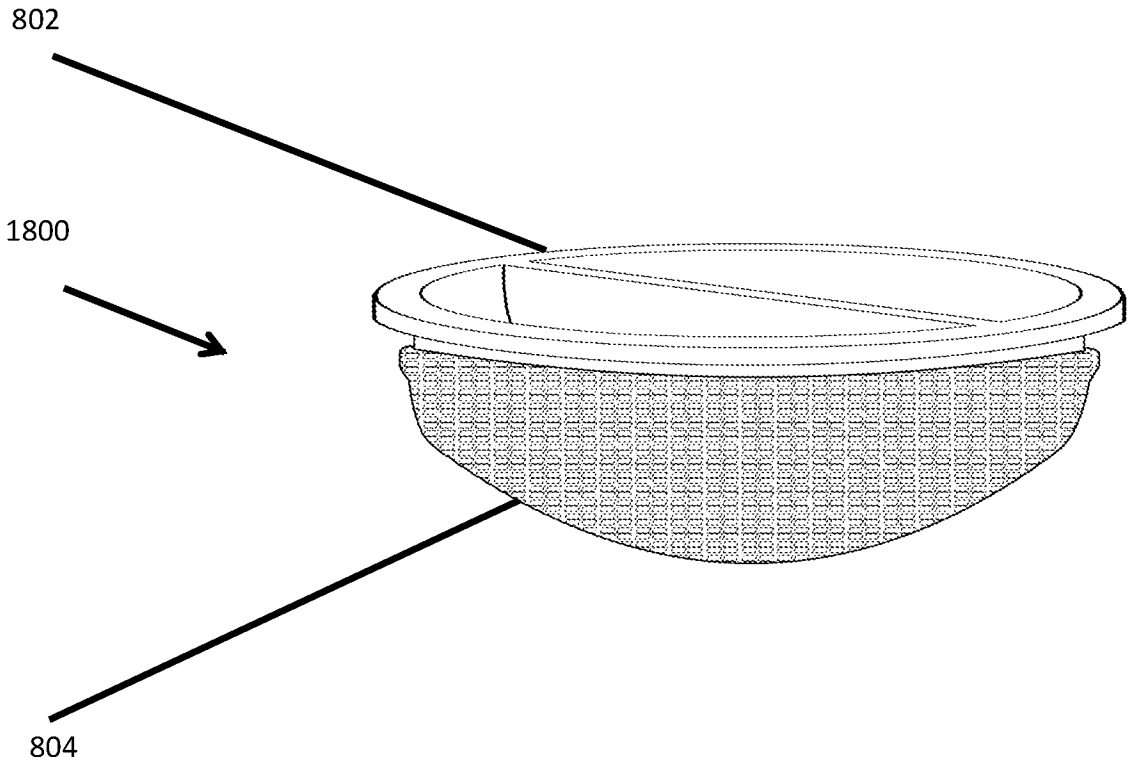
FIG. 18D is a perspective view of the alternate brush head cover of FIG. 18A, the brush frame of FIG. 8B and the absorbent pad of FIG. 8B in a coupled state, wherein the absorbent pad of FIG. 8B is captured between the alternate brush head cover of FIG. 18A and the brush frame of FIG. 8B.

FIG. 18D presents the brush frame 802, the absorbent pad 804 and alternate brush head cover 1800 in a coupled state, wherein the second nylon ring 1804 of the alternate brush head cover 1800 is elastically stretched to pass over the capture ridge 814 of the brush frame 802 while the absorbent pad 804 is disposed between the base frame 802 and the alternate brush head cover 1800, whereby the absorbent pad 804 is removably secured between the base frame 802 and the alternate brush head cover 1800.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible configurations or aspects of the Present Invention. The examples given should only be interpreted as illustrations of some of the preferred configurations or aspects of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

I claim:

1. A container comprising:

a base defining an internal reservoir, the base comprising a bottom at a first end of the base and a base wall extending from the bottom;

a strainer forming a plurality of apertures, and the strainer configured to present a concave external side and to couple with the base at the base wall and distal from the base bottom, wherein a convex internal side of the strainer extends toward the base bottom;

a brush, the brush shaped for placement against the strainer concave external side at a position distal from the base bottom, the brush comprising a convex brush frame, a sheet of fabric coupled with the brush frame, and an underlying absorbent pad disposed between and captured between the brush frame and the sheet of fabric, the underlying absorbent pad adapted to accept material exiting the base through the strainer; and a cover, the cover having a cover attachment feature adapted to detachably couple with the base, wherein the cover is shaped to enclose the brush in combination with the base when the cover is coupled with the base.

2. The container of claim 1, further comprising:

an external circumferential threading of the base wall; and an internal circumferential tapping of the cover, whereby the cover and base are detachably coupled by engagement of the external circumferential threading of the base wall with the internal circumferential tapping of the cover.

3. The container of claim 1, further comprising a liner, liner sized and shaped to fully cover the plurality of apertures of the strainer when the cover and the base are coupled.

4. The container of claim 3, wherein the liner is functionally enhanced by providing a plurality of dimples that are shaped to pass through individual apertures of the strainer when the liner is positioned against the strainer.

5. The container of claim 1, wherein the brush further comprises a handle positioned distally from the sheet of fabric.

6. The container of claim 1, wherein the cover includes a pressure feature adapted to direct forces associated with closing the container downward against the liner, strainer and container base so as to effectively hermetically seal the container base reservoir.

7. The container of claim 1, wherein the brush further comprises a circumferential feature and a peripheral ring, the peripheral ring coupled with the sheet of fabric and the peripheral ring shaped and sized to reside within the circumferential feature and press against the circumferential feature so as to capture the underlying absorbent pad.

8. The container of claim 7, wherein the peripheral ring is coupled with the sheet of fabric to define an outer radius of the sheet of fabric.

9. The container of claim 1, further comprising an O-ring disposed between the strainer and the base at a position distal from the base bottom.

10. The container of claim 1, wherein the brush further comprises an external peripheral ring and the sheet of fabric is ultrasonically welded to the external peripheral ring.

11. A container comprising:

a base defining an internal reservoir, the base comprising a bottom at a first end of the base, a base wall extending from the bottom;

a strainer forming a plurality of apertures, and the strainer configured to present a concave external side and to couple with the base at the base wall and distal from the base bottom, wherein a convex internal side of the strainer extends toward the base bottom;

a brush, the brush shaped for placement against the strainer concave external side at a position distal from the base bottom, the brush comprising a convex brush frame, a sheet of fabric coupled with the brush frame and capturing an underlying absorbent pad, the absorbent pad disposed between the sheet of fabric and the brush frame, and the absorbent pad adapted and positioned to accept material exiting the base through the strainer; and a cover, the cover having a cover attachment feature adapted to detachably couple with the strainer, wherein the cover is shaped to enclose the brush when the cover is coupled with the strainer.

12. The container of claim 11, further comprising:

an external circumferential threading of the strainer; and an internal circumferential tapping of the cover, whereby the cover and strainer are detachably coupled by engagement of the external circumferential threading of the strainer with the internal circumferential tapping of the cover.

13. The container of claim 11, further comprising a liner, the liner sized and shaped to fully cover the plurality of apertures of the strainer when the cover and the base are coupled.

14. The container of claim 13, the sealing plate functionally enhanced by providing a plurality of dimples that are shaped to pass through individual apertures of the strainer when the strainer plate is positioned against the strainer.

15. The container of claim 11, wherein the brush further comprises a handle positioned distally from the sheet of fabric.

16. The container of claim 11, wherein the cover comprises a pressure feature adapted to direct forces associated with closing the container downward against the liner, strainer and container base so as to effectively hermetically seal the container base reservoir.

17. The container of claim 11, wherein the brush further comprises a circumferential feature and a peripheral ring, the peripheral ring coupled with the sheet of fabric and the peripheral ring shaped and sized to reside within the circumferential feature and press against the circumferential feature so as to capture the underlying absorbent pad.

18. The container of claim 17, wherein the peripheral ring is coupled with the sheet of fabric to define an outer radius of the sheet of fabric.

19. The container of claim 11, further comprising an O-ring disposed between the strainer and the base at a position distal from the base bottom.

20. The container of claim 11, wherein the brush further comprises an external peripheral ring and the sheet of fabric is ultrasonically welded to the external peripheral ring.

* * * * *